United States Patent [19]

Tomisawa et al.

[11] 3,979,996

[45] Sept. 14, 1976

[54] ELECTRONIC MUSICAL INSTRUMENT

[75] Inventors: Norio Tomisawa, Hamamatsu; Yasuji Uchiyama, Hamakita; Takatoshi Okumura; Toshio Takeda, both of Hamamatsu, all of Japan

[73] Assignee: Nippon Gakki Seizo Kabushiki Kaisha, Japan

[22] Filed: May 27, 1975

[21] Appl. No.: 581,186

[30] Foreign Application Priority Data

May 31, 1974 Japan ..... 49-61709
May 31, 1974 Japan ..... 49-61714

[52] U.S. Cl. ..... 84/1.25; 84/1.01
[51] Int. Cl.[2] ..... G04H 1/04
[58] Field of Search ..... 84/1.01, 1.03, 1.17, 84/1.24, 1.25

[56] References Cited

UNITED STATES PATENTS

| | | | |
|---|---|---|---|
| 3,413,403 | 11/1968 | Jacob | 84/1.25 |
| 3,610,801 | 10/1971 | Fredkin | 84/1.03 |
| 3,697,661 | 10/1972 | Deutsch | 84/1.01 |
| 3,800,060 | 3/1974 | Hallman, Jr. | 84/1.24 |
| 3,801,721 | 4/1974 | Bunger | 84/1.24 |
| 3,809,786 | 5/1974 | Deutsch | 84/1.03 |
| 3,871,261 | 3/1975 | Wells et al. | 84/1.01 |
| 3,882,751 | 5/1974 | Tomisawa | 84/1.01 |

*Primary Examiner*—E. S. Jackmon
*Attorney, Agent, or Firm*—Ladas, Parry, Von Gehr, Goldsmith & Deschamps

[57] ABSTRACT

In a digital type electronic musical instrument in which basic frequency is cumulatively counted and a musical tone waveshape is read from a memory by the resultant output of the cumulative counting, a desired vibrato effect is produced by digitally frequency-modulating the basic frequency. Vibrato information for effecting the frequency-modulation is produced from a vibrato code obtained by counting a clock pulse and a vibrato depth signal and has contents which change as time elapses. The frequency-modulation is made by multiplying the basic frequency with the vibrato information. The vibrato depth may be controlled for each individual keyboard. Vibrato frequency may be changed by changing the frequency of the clock pulse for each keyboard. According to an embodiment of the invention, the vibrato depth progressively increases from the start of reproduction of the musical tone. The speed of change of the vibrato depth may also be controlled for each individual keyboard.

6 Claims, 17 Drawing Figures

TO
KAG1
A16
KAG2
N1
N2
N3
N4
B1
B2
K1
K2
DF3
KAC
EQ*
TO 4
KAM
KA
KA*
G
EQM
EQ
A17
OR3
OR2
ΣEQ
DF2
UNB
I1
I5
A18
A1S
BUM
KOM
KFM
t2
ES
t4
DIS
CC
NKO
A20
I2
A19
A24
A25
I9
OR9
KD
DF
IC

ELECTRONIC MUSICAL INSTRUMENT

SUMMARY OF THE INVENTION

This invention relates to a digital type electronic musical instrument capable of producing a musical tone provided with a vibrato effect.

A digital type electronic musical instrument which produces a musical tone by digitally processing a signal generated upon depression of a key has many advantages over an analog type electronic musical instrument particularly in compactness in size and superior tone quality. It is not long, however, since the digital type electronic musical instrument came into being and there has not been an instrument of this type capable of providing a musical tone with vibrato and other effects which are obtainable in a natural musical tone.

It is, therefore, an object of the invention to provide an electronic musical instrument capable of producing a vibrato effect by digitally frequency-modulating a signal.

It is another object of the invention to provide an electronic musical instrument according to which not only production of a vibrato effect is ensured but the circuit construction can be made compact by employment of an integrated circuit and the manufacturing cost is reduced.

It is another object of the invention to provide an electronic musical instrument capable of controlling a vibrato frequency and a vibrato depth individually for each keyboard.

It is still another object of the invention to provide an electronic musical instrument capable of producing a vibrato effect of which the vibrato depth progressively increases for each predetermined period of time after starting of production of a musical tone (hereinafter sometimes called "the delay vibrato effect").

These and other objects and features of the invention will become apparent from the description made hereinbelow with reference to the accompanying drawings.

BRIEF DESCRIPTION OF THE DRAWINGS

FIGS. 10(*b*) through 10(*d*) are graphic diagrams illustrative of outputs at various points of the vibrato information generator 11 shown in FIG. 9;

FIG. 16(*b*) is a graphic diagram showing an example of progressive increase in the vibrato depth;

FIGS. 16(*c*), and (*d*) are graphic diagrams showing examples of change in the vibrato depth.

DESCRIPTION OF THE PREFERRED EMBODIMENTS

I. General construction

Figure 1:
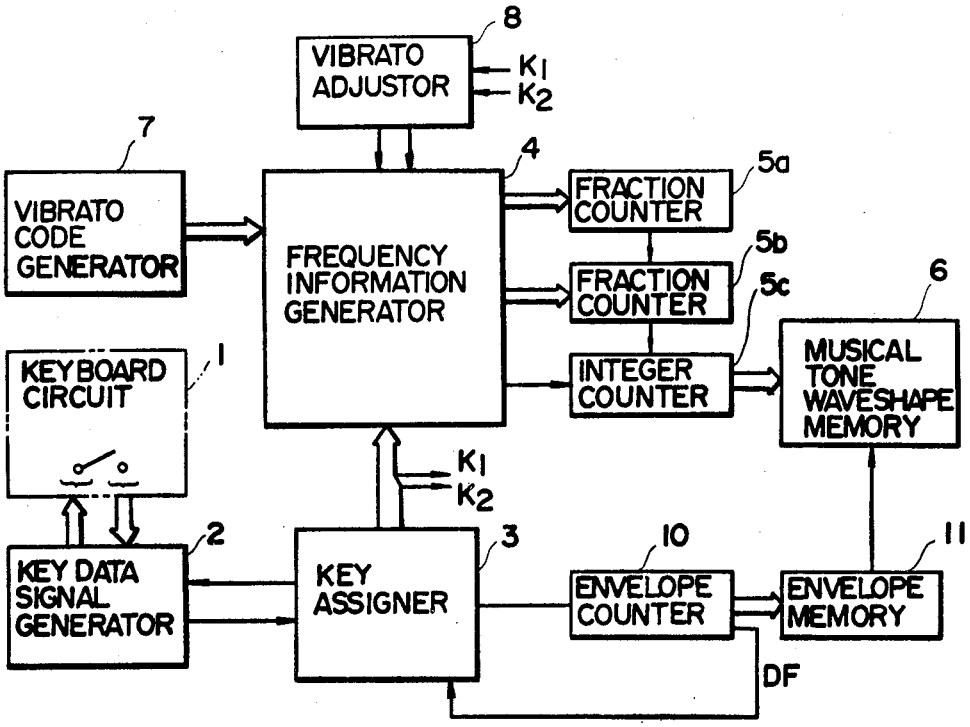
FIG. 1 is a block diagram showing one preferred embodiment of the electronic musical instrument according to the invention.

Referring first to FIG. 1 which shows one preferred embodiment of the electronic musical instrument according to the present invention, a keyboard circuit 1 has make contacts corresponding to respective keys. A key data signal generator 2 comprises a key address code generator which produces key address codes indicative of the notes corresponding to the respective keys successively and repeatedly. The key data signal generator 2 produces a key data signal when a make contact corresponding to a depressed key is closed and the key address code corresponding to the depressed key is produced. This key data signal is applied to a key assigner 3. The key assigner 3 comprises a key address generator which operates in synchronization with the above described key address code generator, a key address code memory which is capable of storing a plurality of key address codes and successively and repeatedly outputting these key address codes and a logical circuit which, upon receipt of the key data signal, applies the key data signal to the key address code memory for causing it to store the corresponding key address code on the condition that this particular key address code has not been stored in any channel of the memory yet and that one of the channels of the memory is available for storing this key address code.

A frequency information generator 4 comprises a frequency information memory which stores frequency information corresponding to the respective key address codes (hereinafter referred to as "basic frequency information") and a frequency information modulator (not shown). The frequency information memory, upon receipt of a key address code from the key assigner 3, produces basic frequency information corresponding to the key address code. The frequency modulator produces vibrato information upon receipt of a vibrato code which determines a vibrato frequency from a vibrato code generator 7 and a vibrato depth signal which is used to adjust the rate of frequency variations from a vibrato adjustor 8. The basic frequency information is frequency-modulated by this vibrato information. The frequency-modulated frequency information consists of binary data having a fraction section and an integer section as will be described in detail later, the fraction section being applied to fraction counters 5*a* and 5*b* and the integer section to an integer counter 5*c*.

The vibrato code generator 7 comprises a clock select circuit which generates a clock pulse in accordance with the speed of vibrato, i.e. the period of frequency variations, and a vibrato counter which produces a vibrato code by counting this clock pulse. The vibrato adjustor 8 comprises an operator for adjusting the depth of vibrato, i.e. the rate of frequency variations, by each keyboard and a data select circuit which produces a signal used to adjust the rate of frequency variations by each keyboard (hereinafter referred to as "depth signal") in response to the signal sent from the operator and keyboard codes $K_1$, $K_2$ to be described later.

The fraction counter 5*a* is provided for cumulatively counting its inputs and applying a carry signal to the next fraction counter 5*b* when a carry takes place in the addition. The fraction counter 5*b* is of a like construction, applying a carry signal to the integer counter 5*c* when a carry takes place in the counter 5*b*.

The integer counter 5*c* cumulatively counts the carry signals and integer section information inputs and successively delivers out signals representing the results of the addition. The output signals of the integer counter 5*c* are applied to a plurality of input terminals of a waveshape memory 6. A musical tone waveshape for one period is sampled at *n* points and the amplitudes of the sampled waveshape are stored at addresses 0 to n-1 of the waveshape memory 6. The musical tone waveshape is read from the waveshape memory 6 by successively reading out the amplitudes at the addresses corresponding to the output of the integer counter 5*c*.

The entire level of the waveshape signal read from the waveshape memory 6 is controlled by an envelope waveshape signal provided by an envelope memory 11. The envelope memory 11 stores a waveshape corresponding to an envelope formed during a period of time from the start of reproduction of a musical tone till the stop thereof. The envelope memory 11 is constructed in a similar manner to the waveshape memory 6 and the amplitudes at the addresses corresponding to the outputs of an envelope counter 10 are successively read out. The counting in the envelope counter 10 is controlled by signals provided by the key assigner 3 and respectively representing depression and release of a key. When the counting in the envelope counter 10 is completed, a count finish signal DF is applied to the key assigner 3. The key assigner 3, upon receipt of this count finish signal DF, applies a reset signal cc to the vibrato adjustor 8 to restore the vibrato depth signal produced by the vibrato adjustor 8 to its initial condition.

For achieving the purpose of reproducing plurality of musical tones simultaneously, the present electronic musical instrument has a construction based on dynamic logic so that the counters, logical circuits and memories provided therein are used in a time-sharing manner. Accordingly, time relations between clock pulses controlling the operations of these counters etc. are very important factors for the operation of the present electronic musical instrument.

Figure 2:
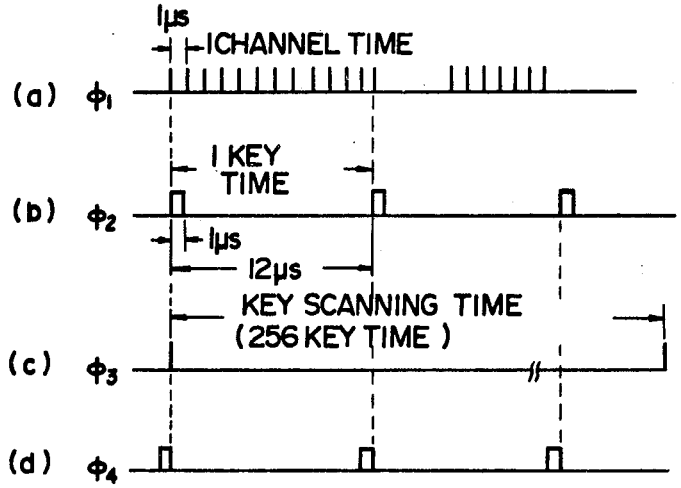
FIGS. 2(*a*) through 2(*d*) are respectively charts showing clock pulses employed in this embodiment of the electronic musical instrument.

Assuming that a maximum number of musical tones to be reproduced simultaneously is twelve, relations between the various clock pulses used in the present electronic musical instrument are illustrated in FIGS. 2(*a*) to 2(*d*). FIG. 2(*a*) shows a main clock pulse $\phi_1$ which has a pulse period of 1 $\mu$s. This pulse period is hereinafter referred to as "channel time" FIG. 2(*b*) shows a clock pulse $\phi_2$ having a pulse width of 1 $\mu$s and a pulse period of 12 $\mu$s. This pulse period of 12 $\mu$s is hereinafter referred to as "key time". FIG. 2(*c*) shows a key scanning clock pulse $\phi_3$ which has a pulse period equivalent to 256 key times. One key time is divided by 12 $\mu$s and each fraction of the divided key time is called first, second ..... twelfth channel respectively. FIG. 2(*d*) shows a clock pulse $\phi_4$ which appears only during the twelfth channel in each key time. A channel denotes in this specification a shared portion of time, i.e. the channel time.

II. Generation of key address codes

Figure 3:
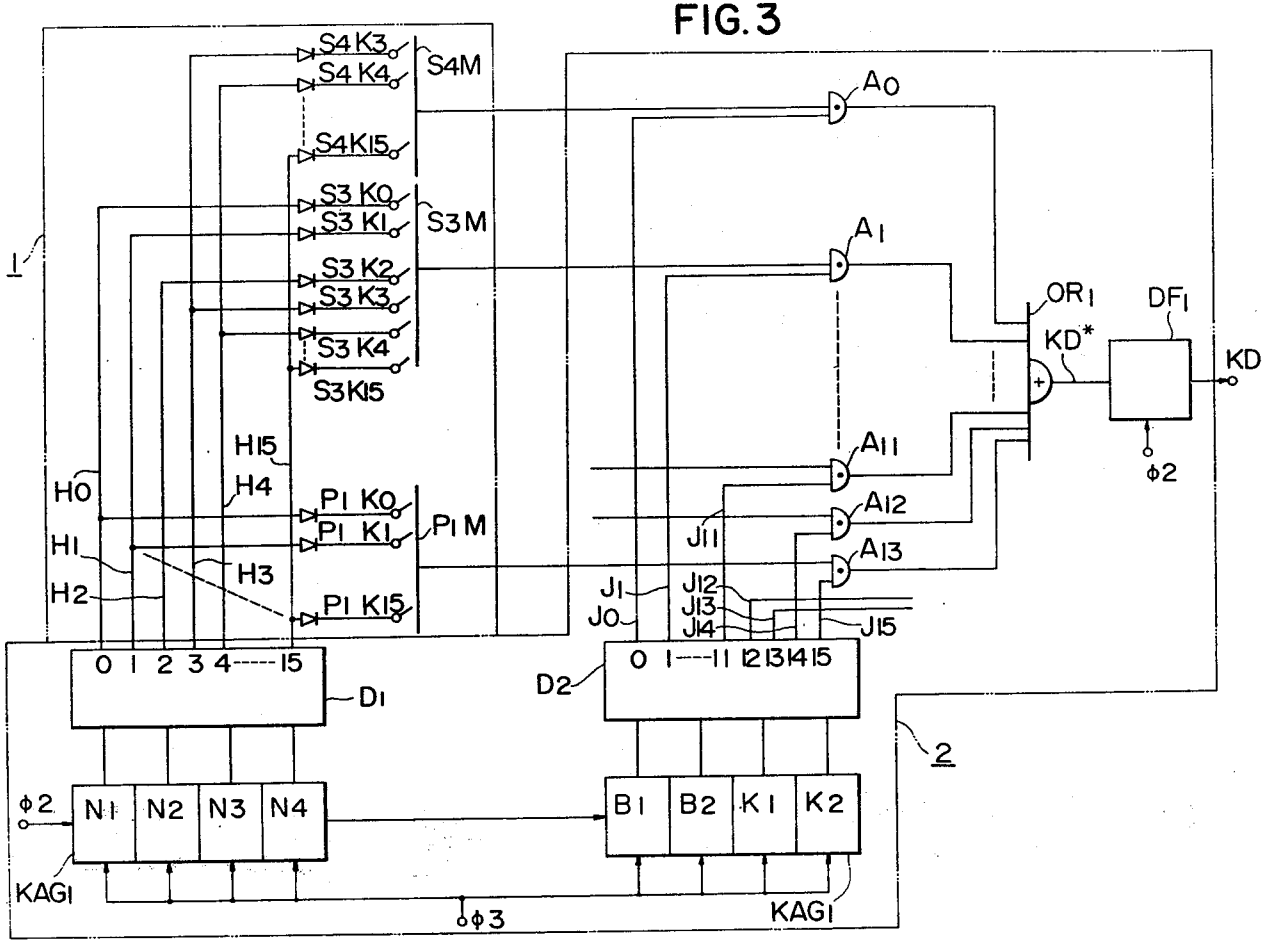
FIG. 3 is a circuit diagram showing a detailed logical circuit of a key data signal generator 2, shown in FIG. 1.

FIG. 3 shows the construction of the key data generator 2 in detail. A key address code generator $KAG_1$ consists of binary counters of eight stages. The clock pulse $\phi_2$ with the pulse period of 12 $\mu$s (hereinafter called a key clock pulse) is applied to the input of the key address code generator $KAG_1$. The key clock pulse applied to the key address code generator $KAG_1$ changes the code, i.e., the combination of 1 and 0 in each of the binary counter stages.

The highest class of electronic musical instrument typically has a solo keyboard, upper and lower keyboards and a pedal keyboard. The pedal keyboard has 32 keys ranging from $C_2$ to $C_4$ and the other keyboards respectively have 61 keys ranging from $C_2$ to $C_7$. Thus, this type of electronic musical instrument has 215 keys in all.

According to the present invention, 256 different codes are produced by the key address code generator $KAG_1$ and 215 codes among them are alloted to the corresponding number of keys. Digits of the key address code generator $KAG_1$ from the least significant digit up to the most significant digit are represented by reference characters $N_1$, $N_2$, $N_3$, $N_4$, $B_1$, $B_2$, $k_1$ and $K_2$ respectively. Among them, $K_2$ and $K_1$ constitute a keyboard code representing the kind of keyboard, $B_2$ and $B_1$ a block code representing a block in the keyboard and $N_1$ through $N_4$ a note code representing a musical note in the block. Each keyboard is divided into four blocks each block including 16 keys. These blocks are designated as block 1, block 2, block 3 and block 4 counting from the lowest note side. It is assumed that the key address codes which would correspond to three notes above the actually existing highest key (note $C_6$ of block 4) in the solo keyboard S, upper keyboard U and lower keyboard L and the key address codes which would correspond to the blocks 3 and 4 in the pedal keyboard are not alloted to keys in the present embodiment.

The bit outputs of the key address code generator $KAG_1$ are applied through decoders to the keyboard circuit for sequentially scanning each key. The scanning starts from the block 4 of the solo keyboard S and is performed through the blocks 3, 2, 1 of the solo keyboard S, the blocks 4, 3, 2, 1 of the upper keyboard U, the blocks 4, 3, 2, 1 of the lower keyboard L and the blocks 2, 1 of the pedal keyboard P. One cycle of scanning of all of the keys is thereby completed and this scanning operation is cyclically repeated at an extremely high speed. Scanning time required for one cycle of scanning is $256 \times 12\ \mu s = 3.07$ ms.

Decoder $D_1$ is a conventional binary-to-one decoder designed to receive four-digit binary codes consisting of combinations of the digits $N_1$ to $N_4$ of the key address code generator $KAG_1$ and to deliver an output at one of the sixteen individual output lines $H_0$ through $H_{15}$ successively and sequentially, the binary code in each instance determining a respective output line. The output line $H_0$ is connected through diodes to the key switches corresponding respectively to the highest note of each block (except the blocks 4) of the respective keyboards. The output line $H_1$ is similarly connected to the key switches corresponding to the second highest note of each block except the blocks 4. It will be understood that no keys are provided for the three codes on the highest note side in the block 4 of the solo keyboard S, the upper keyboard U and the lower keyboard L and, accordingly, the output lines $H_0$ to $H_2$ are not connected in the blocks 4. Output line $H_3$ and subsequent output lines are connected in a similar manner to the corresponding key switches of each block (also of block 4).

FIG. 3 illustrates connections between respective key switches and the output lines $H_0 - H_{15}$ with respect to the blocks 4 and 3 of the solo keyboard S and the block 1 of the pedal keyboard P. The first letter of the synbols used on the key switches designates the kind of the keyboard, the number affixed to the first letter the block number, and the numeral affixed to the letter K a decimal value of the corresponding one of the codes $N_1 - N_4$.

Each key switch has a make contact. One contact points thereof is individually connected as has been described above and the other contact point constitutes a common contact for each block. The common contacts $S_4M - P_1M$ are respectively connected to AND circuits $A_0 - A_{13}$.

Decoder $D_2$ is a conventional binary-to-one decoder designed to receive four-digit binary codes consisting of combinations of the digits $B_1$, $B_2$, $K_1$ and $K_2$ of the key address code generator $KAG_1$ and to deliver an output at one of the sixteen individual output lines $J_0$ through $J_{15}$ successively and sequentially, the binary code in each instance determining a respective output line. The output lines $J_0$ through $J_{15}$ (except $J_{12}$ and $J_{13}$) are connected to the inputs of the AND circuits $Y_0$ through $Y_{13}$ respectvely. The outputs of the AND circuits $Y_0$ through $Y_{13}$ are connected through an OR circuit $OR_1$ to the input of a delay flip-flop circuit $DF_1$.

The codes produced from the key address code generator $KAG_1$ change their contents every time the key clock pulse $\phi_2$ is applied.

If a certain key is depressed, the make contact corresponding to the depressed key is closed. When the key address code generator $KAG_1$ provides a code which corresponds to the depressed key, an output 7 is produced from one of the AND circuits $A_0 - A_{13}$. This output is provided via an OR circuit $OR_1$. This output is a key data signal KD* which represents the closing of the make contact. This signal is delayed by the delay flip-flop $DF_1$ by one key time and provided therefrom. The key data signals KD*, KD are sequentially output with an interval of 3.07 ms as long as the make contact remains closed.

The foregoing description has been made with regard to a case where only one key is depressed. If a plurality of keys are depressed simultaneously, key data signals respectively corresponding to the depressed keys are produced in the same manner and different musical tone wave shapes respectively corresponding to these key data signals are obtained. For convenience of explanation, description will be made hereinbelow about a case where only one key is depressed to obtain one musical tone waveshape.

Figure 4:
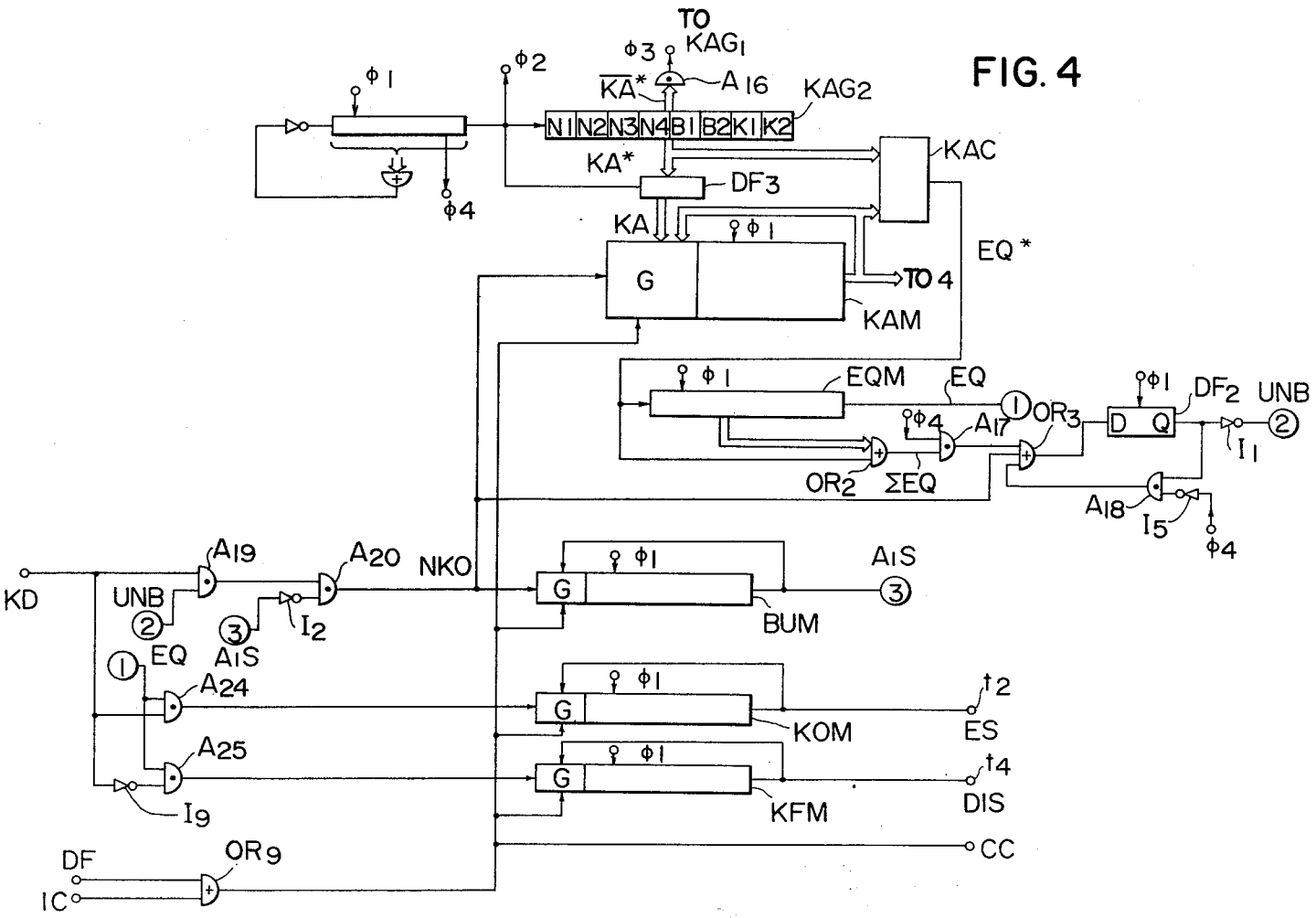
FIG. 4 is a circuit diagram showing a detailed logical circuit of a key assigner 3 shown in FIG. 1.

FIG. 4 is a block diagram showing the construction of the key assigner 3 in detail. A key address code memory KAM has memory channels of a number equal to that of the musical tones to be reproduced at the same time, each of the these channels storing a key address code representing the musical note being played. The key address code memory KAM is adapted to apply the key address code in a time-sharing manner to the frequency information generator 4 as a frequency designation signal. In the present embodment, a shift register of 12 words - 8 bits is utilized as the key address code memory KAM. This shift register performs shifting upon receipt of the main clock pulse $\phi_1$ produced at an interval of 1 $\mu$s. The output from the last stage of this shift register is provided to the frequency information memory and, simultaneously, fed back to its input side, Accordingly, each key address code is circulated in the shift register at a cycle of 1 key time (12 $\mu$s) unless the code is cleared from its corresponding channel.

A key address code generator $KAG_2$ is of the same construction as the key address code generator $KAG_1$. These two generators $KAG_1$ and $KAG_2$ operate in exact synchronization with each other. More specfically, the key clock pulse $\phi_2$ is used as input signals to both of the generators $KAG_1$ and $KAG_2$ and the fact that the respective bits of the key address code generator $KAG_2$ are all 0 is detected by an AND circuit $A_{16}$ and the detected signal $\phi_3$ is applied to the reset terminals of the respective bits of the key address code generator $KAG_1$ as the key scanning clock signal. The key assigner 3 causes the key address code memory KAM to store a key address code corresponding to the key data signal KD upon receipt thereof when the following two conditions are satisfied:

Condition A; The key address code is not identical with any of the codes already stored in the key address code memory KAM.

Condition B; there is a not-busy channel. i.e. a channel in which no code is stored, in the key address code memory KAM.

Assume now that a key data signal KD* is produced from the OR circuit $OR_1$. At this time the key address code from the key address code generator $KAG_2$ coincides with the code of the key address code generator $KAG_1$ and represents the note of the depressed key. During the 12 $\mu$s period, the key address cod KA* is applied to a comparison circuit KAC in which the code KA* is compared with each output of the channels of the key address code memory KAM. A coincidence signal EQ* produced from the comparison circiuit KAC is 1 when there is coincidence and 0 when there is no coincidence. The coincidence signal EQ* is applied to a coincidence detection memory EQM and also to one input terminal of an OR circuit $OR_2$. This memory EQM is a shift register having a suitable number of bits, e.g. 12 as in this embodiment. The memory EQM successively shifts the signal EQ*, i.e. delays it by one key time when the signal EQ* is 1 and thereby produces a coincidence signal EQ (=1). Each of the outputs from the first to eleventh bits of the coincidence detection memory EQM is applied to the OR circuit $OR_2$. Accordingly, the OR circuit $OR_2$ produces an output when either the signal EQ* from the comparison circuit KAC or one of the outputs from the first to eleventh bits of the shift register EQM is 1. The output signal Σ EQ of the OR circuit $OR_2$ is applied to one of the input terminals of an AND circuit $A_{17}$. The AND circuit $A_{17}$ receives a clock pulse $\phi_4$ at the other input terminal thereof. Since information stored in the shift register before the first channel is false information, correct information, i.e. information representing the result of comparison between the key address code KA* and the codes in the respective channels of the key address code memory KAM is obtained only when the result of the comparison in each of the first to eleventh channels is applied to the coincidence detection memory EQM and the result of comparison in the twelfth channel is applied directly to the OR circuit $OR_2$. This is the reason why the clock pulse $\phi_4$ is applied to the AND circuit $A_{17}$.

If the signal Σ EQ is 1 when the clock pulse $\phi_4$ is applied, the AND circuit $A_{17}$ produces an output 1 which is applied through an OR circuit $OR_3$ to a delay flip-flop $DF_2$. The signal is delayed by this delay flip-flop $DF_2$ by one channel time and fed back thereto via an AND circuit $A_{18}$. Thus, the signal 1 is stored during one key time until a next clock pulse $\phi_4$ is applied to the AND circuit $A_{18}$ through an inverter $I_5$. The output 1 of the delay flip-flop $DF_2$ is inverted by an inverter $I_1$ and is provided as an unblank signal UNB. This unblank signal UNB indicates that the same code as the key address code KA* is not stored in the key address code memory KAM when it is 1, and that the same code as the key address code KA* is stored in the memory KAM when it is 0.

As described in the foregoing, presence of the condition (A) is examined during production of the key data signal KD*. In other words, whether the key data signal is an old signal which has already been stored or a new one which has not been stored in the memory is examined. The unblank signal UNB which indicates the result of the examination is applied to one input terminal of an AND circuit $A_{19}$ during the next one key time. The key data signal KD is delayed by one key time and applied to the other input terminal of the AND circuit $A_{19}$. Accordingly, whether a key address code corresponding to the key data signal KD has been stored in the memory KAM is examined by one key time immediately before the application of the key data signal KD. When the unblank signal UNB is 1, the key data signal KD is applied to one of the input terminals of an AND circuit $A_{20}$ via the AND circuit $A_{19}$. When the unblank signal UNB is 0, the key data signal KD is not gated out of the AND circuit $A_{19}$.

In order for a new key address code to be stored in the key address code memory KAM, at least one of the twelve channels of the memory must be in a not-busy state, i.e. available for storage. A busy memory BUM is provided to detect whether there is a not-busy channel in the key address code memory. The busy memory BUM consists of a shift register of 12 bits, and is adapted to store 1 when a new key-on signal NKD is applied thereto from an AND circuit $A_{20}$. This signal 1 is sequentially and cyclicly shifted in the busy memory BUM. This new key-on signal is simultaneously applied to the key address code memory KAM so as to cause the memory KAM to store the new key address code. Accordingly, the signal 1 is stored in one of the channels of the busy memory BUM correspondingly to the busy channel of the key address code memory KAM. Contents of a not-busy channel are 0. Thus, the output of the final stage of the busy memory BUM indicates whether this channel is busy or not. This output is hereinafter referred to as a busy signal $A_1S$.

This busy signal $A_1S$ is applied to one of the input terminals of the AND circuit $A_{20}$ via an inverter $I_2$. When the signal $A_1S$ is 0, i.e., a certain channel is not busy, the key data signal is applied to the busy memory BUM as the new key-on signal via the AND circuit $A_{20}$ thereby causing the busy memory BUM to store 1 in its corresponding channel. Simultaneously, the gate G of the key address code memory KAM is controlled so that the key address code KA from a delay flip-flop $DF_3$ will be stored in a not-busy channel of the memory KAM.

The delay flip-flop $DF_3$ is provided for delaying the output KA* of the key address code generator KAG by one key time so that a key address code corresponding to the key data signal KD may be stored in synchronization with the key data signal KD, since the key data signal KD* which is delayed by one key time is applied to the key assigner.

The new key-on signal NKO from the AND circuit $A_{20}$ is applied through the OR circuit $OR_3$ to the delay flip-flop $DF_2$ to set the flip-flop, and the unblank signal UNB becomes 0. Accordingly, the output of the AND circuit $A_{19}$ becomes 0 when the unblank signal UNB becomes 0 thereby changing the new key-on signal NKO to 0. This arrangement is provided to ensure storage of the key address code KA in only one, and not two or more, not-busy channel of the key address code memory KAM.

In this way, twelve kinds of key address codes are stored in the key address code memory KAM, and these address codes are shifted by the main clock pulse $\phi_1$ and the outputs of the final stage are successively applied to the frequency information generator 4 and also fed back to the input side of the memory KAM for cyclically producing outputs therefrom, changing at a rate of 1 μs, i.e. the same code appearng once every 12 μs.

Assume now that a key address code has been stored in the first channel. If the key data signal KD is applied to one of the input terminals of an AND circuit $A_{24}$, a signal 1 is applied to the other input terminal of the AND circuit $A_{24}$, since 1 is already stored in the first channel of the coincidence memory EQM. Accordingly, the key data signal KD is gated out of the AND circuit $A_{24}$ only during the time correspondng to the first channel and stored in the first channel of the key-on memory KOM.

The storage of the signal 1 in the key-on memory KOM represents a state in which the make contact of the key switch is closed (hereinafter referred to as "key-on").

The signal 1 of the first channel of the key-on memory KOM is also supplied to a terminal $t_2$ as an attack start signal ES. This attack start signal ES is continuously produced until the signal 1 of the first channel of the key-on memory KOM is reset as will be described later.

When the key is released, the key data signal ceases to be produced. This causes a signal 1 produced through an inverter $I_9$ to be applied to one of the input terminals of an AND circuit $A_{25}$. The coincidence signal EQ is still being applied to the other input terminal of the AND circuit $A_{25}$. Accordingly, a signal 1 is stored in the first channel of a key-off memory KFM. The contents of the first channel are successively shifted in the key-off memory KFM and are output from the last stage thereof as a signal 1. This signal 1 which is applied to a terminal $t_4$ represents a key-off stage and hereinafter is called a decay start signal DIS.

The contents of the memories of the key assigner 8 is cleared by applying to the input terminal of the OR circuit $OR_9$ a counting termination signal DF from an envelope counter to be described later when reading of envelope waveshapes has been completed. The output of the OR circuit $OR_9$ is also utilized as a clear signal CC for clearing each counter. One input IC to the OR circuit $OR_9$ is an input for resetting the respective memories and counters to their initial conditions upon turning-on of the power.

In the above described manner, the key address codes $N_1 - K_2$, the attack start signal ES and the decay start signal DIS are produced.

It should be noted that the key address codes $N_1 - B_2$ representing the notes are applied to the frequency information memory and the key address codes $K_1$, $K_2$ representing the keyboards are utilized as desired for controlling a musical tone for each keyboard.

III. FREQUENCY INFORMATION GENERATOR

Figure 5:
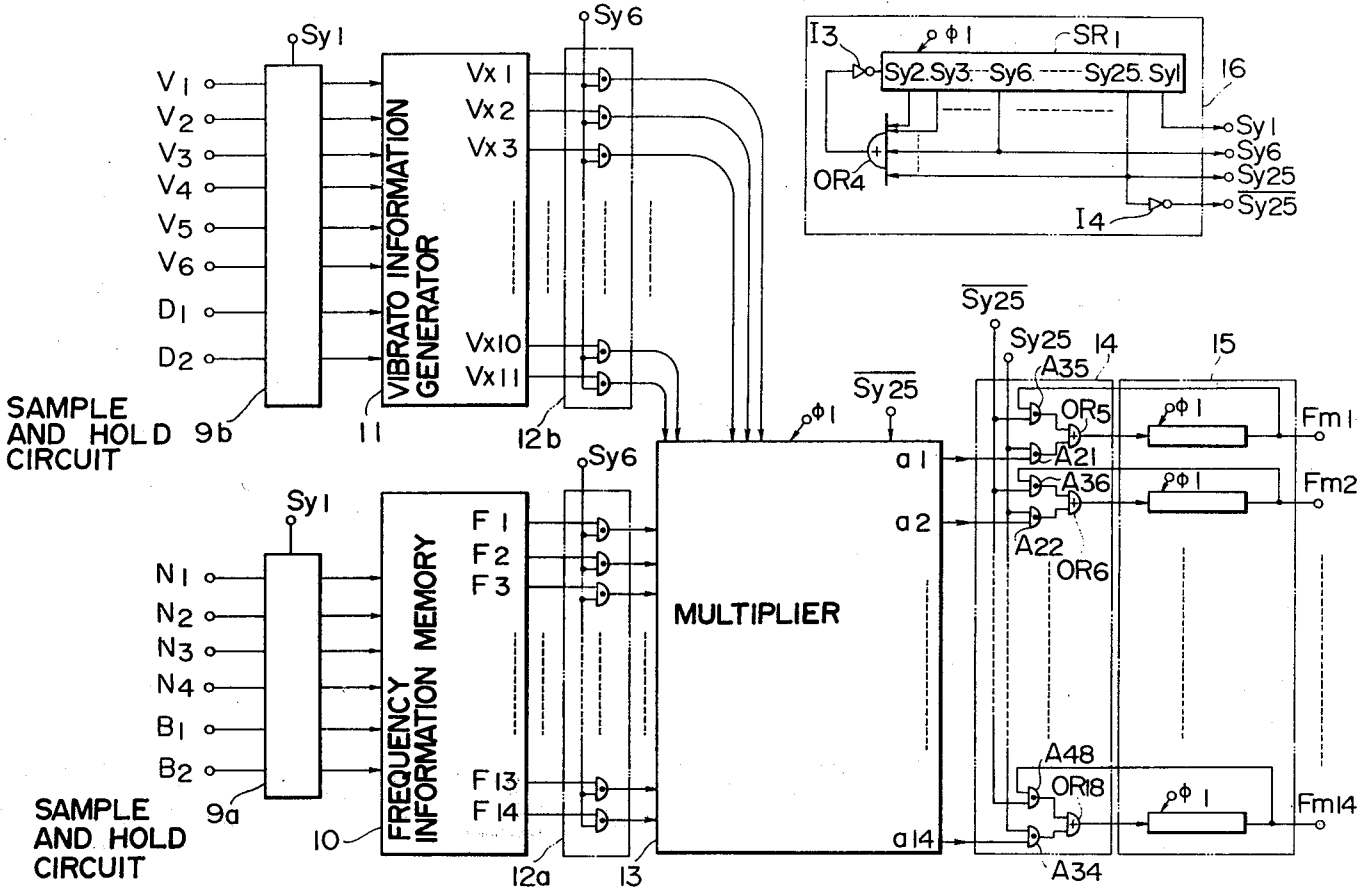
FIG. 5 is a block diagram showing in detail a frequency information generator 4 shown in FIG. 1.

FIG. 5 is a schematic block diagram showing the frequency information generator 4. The frequency information generator comprises the frequency information memory 10, the vibrato information generator 11, the multiplier 13 and the output shift register group 15.

The frequency information memory 10 stores information representing a plurality of predetermined frequencies corresponding to the respective key address codes and produces basic frequency information $F_1 - F_{14}$ for a particular key address code (a combination selected from $N_1$, $N_2$, $N_3$, $N_4$, $B_1$ and $B_2$) when this key address code is applied thereto.

The frequency information for each frequency consists of a suitable number of bits, e.g. 14 as in the present embodiment. One bit of the 14 bits represents an integer section and the rest of the bits, i.e. 13, represent a fraction section. The following Table I illustrates an example of the frequency information corresponding to keys $C_1$, $C_2$, $C_3$, $C_4$, $C_5$, $C_6$, $D_5$# and $E_5$.

Table I

| | Integer section | Binary fraction section | | | | | | | | | | | | | |
|---|---|---|---|---|---|---|---|---|---|---|---|---|---|---|---|
| key | $F_{14}$ | $F_{13}$ | $F_{12}$ | $F_{11}$ | $F_{10}$ | $F_9$ | $F_8$ | $F_7$ | $F_6$ | $F_5$ | $F_4$ | $F_3$ | $F_2$ | $F_1$ | F-number |
| $C_1$ | 0 | 0 | 0 | 0 | 0 | 1 | 1 | 0 | 1 | 0 | 1 | 1 | 0 | 0 | 0.052325 |
| $C_2$ | 0 | 0 | 0 | 0 | 1 | 1 | 0 | 1 | 0 | 1 | 1 | 0 | 0 | 1 | 0.104650 |
| $C_3$ | 0 | 0 | 0 | 1 | 1 | 0 | 1 | 0 | 1 | 1 | 0 | 0 | 1 | 0 | 0.209300 |
| $C_4$ | 0 | 0 | 1 | 1 | 0 | 1 | 0 | 1 | 1 | 0 | 0 | 1 | 0 | 1 | 0.418600 |
| $C_5$ | 0 | 1 | 1 | 0 | 1 | 0 | 1 | 1 | 0 | 0 | 1 | 0 | 1 | 0 | 0.837200 |
| $D_5$# | 0 | 1 | 1 | 1 | 1 | 1 | 1 | 1 | 0 | 1 | 1 | 1 | 0 | 0 | 0.995600 |
| $E_5$ | 1 | 0 | 0 | 0 | 0 | 1 | 1 | 1 | 0 | 0 | 0 | 0 | 0 | 0 | 1.054808 |
| $C_6$ | 1 | 1 | 0 | 1 | 0 | 1 | 1 | 0 | 0 | 1 | 0 | 1 | 0 | 0 | 1.674400 |

In this table, the F-number represents the basic frequency information $F_1 - F_{14}$ expressed in a decimal notation, with the most significant digit $F_{14}$ being placed in the integer section.

The basic frequency information is determined in such a manner that it corresponds to a musical tone of a normal pitch without any vibrato effect being afforded thereto. Assume that the waveshape of the musical tone to be reproduced is stored at 64 sampled analog values at 64 sample points and the frequency of the tone to be reproduced is represented by $f$. The frequency information F is represented by the following equation:

$$F = 12 \times 64 \times f \times 10^{-6}$$

If one key time is 12 $\mu$s, the number of times per second F is accumulated in the frequency counters 5*a* to 5*c* is $1/12 \times 10^6$.

This frequency information F is stored in the memory 10 in correspondence to the frequency $f$ to be obtained and this constitutes the basic frequency information $F_1 - F_{14}$ as shown in Table 1.

The vibrato information generator 11 produces vibrato information $V_{x1} - V_{x11}$ which is used for providing a musical tone to be reproduced with slight frequency variations with a certain period. These frequency variations are achieved by slightly changing the values of the basic frequency information $F_1 - F_{14}$ in accordance with the above period. The vibrato information $V_{xl} - V_{x11}$ is binary data respectively represented in termns of a certain rate to the basic frequency information $F_1 - F_{14}$. This rate changes as time elapses in accordance with the addresses of the vibrato codes $V_1 - V_6$ to be described later and is controlled in its magnitude in accordance with the values of depth signals $D_1$ and $D_2$. More specifically, the vibrato information $V_{x1} - V_{x11}$ is represented as functions of the vibrato codes $V_1 - V_6$ with these vibrato codes being used as variables. The depth signals $D_1$, $D_2$ participate in the functions as coefficients. Accordingly, the period of the frequency variations is determined by these vibrato codes $V_1 - V_6$ and the rate of the frequency variations is determined by the depth signals $D_1$ and $D_2$.

The vibrato information generator 11 may be constructed of any conventional device if it can produce the vibrato information $V_{x1} - V_{x11}$ in the form of the above described function. In order to produce an accurate vibrato effect, the function should preferably be a periodic function, e.g. a trigonometrical function. The vibrato information $V_{x1} - V_{x11}$ can be formed as a trigonometrical function by reading from a sinusoidal waveshape memory binary data of respective amplitudes at the addresses corresponding to the vibrato codes $V_1 - V_6$ and multiplying the read out binary data with the depth signals $D_1$ and $D_2$. For simplicity of construction of the instrument, the vibrato information in the present embodiment is formed as a triangular waveshape information which is constituted of the vibrato codes $V_1 - V_6$ and the depth signals $D_1$ and $D_2$.

Basic frequency information $F_1 - F_{14}$ is digitally frequency-modulated by multiplying it with the vibrato information $V_{x1} - V_{x11}$ in a multiplier 13 and frequency information provided with the vibrato effect thereby is obtained.

A digital type multiplier performs multiplication by repetition of addition and, if multiplier and multiplicand consist of many digits, time required for repetition of addition and carrying to complete a single multiplication must be taken into consideration. For achieving an accurate multiplication it is indispensable that time required for multiplication be synchronized with the operation of the entire system. According to the invention, a synchronization signal generation circuit 16 is provided for synchronization between the component parts of the frequency information generator 4.

The synchronization signal generation circuit 16 generates a synchronizing pulse Sy 1 used for synchronization between an input signal to the frequency information memory 10 and an input signal to the vibrato information generator 11, a synchronizing pulse Sy 6 used for synchronization between input signals to the multiplier 13 supplied from the frequency information memory 10 and the vibrato information generator 11, a synchronizing pulse Sy 25 used for outputting a result of multiplication from the multiplier 13 when the time required for multiplication has elapsed since application of an input thereto by means of the synchronizing pulse Sy 6 and a signal $\overline{\text{Sy 25}}$ which is of an opposite polarity to the signal Sy 25.

Figure 6:
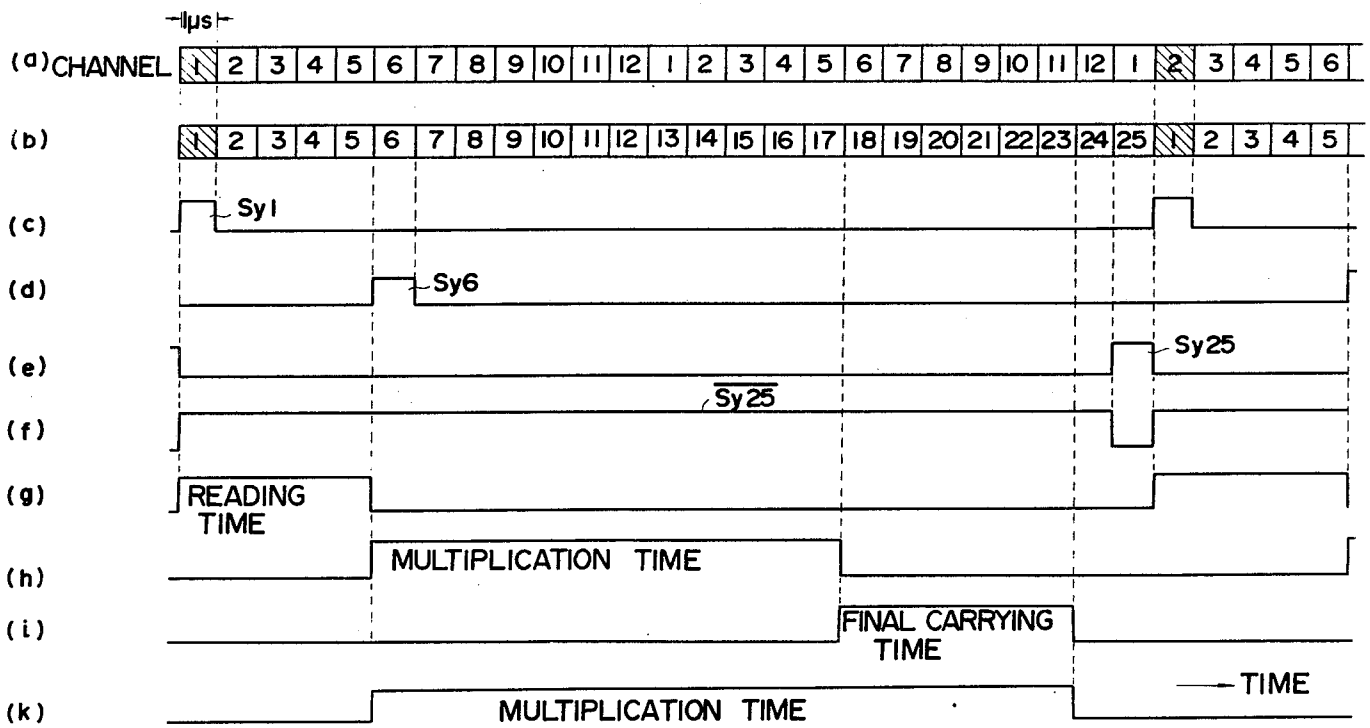
FIGS. 6(*a*) through 6(*k*) are timing charts illustrative of signals at respective points in the frequency information generator 4 shown in FIG. 5.

In determining time interval between the synchronizing pulses Sy 1 and Sy 6, the operation time of the frequency information memory 10 and the vibrato information generator 11 is considered and, in determining time interval between the synchronizing pulses Sy 6 and Sy 25, the operation time of the multiplier 13 is considered. Assume now that a maximum number of musical tones to be reproduced simultaneously is 12. The synchronizing signal generation circuit 16 comprises a one-input-parallel-output type shift register $SR_1$ with 25 bits, an OR gate $OR_4$ receiving outputs of the first to the 24th bits of the shift register $SR_1$, inverters $I_3$ and $I_4$. The contents in the shift register $SR_1$ are shifted by the clock pulse $\phi_1$ every 1 $\mu$s and the output from the 5th bit is used as the synchronizing pulse Sy 6, the one from the 24th bit as the synchronizing pulse Sy 25 and the one from the 25th bit as the synchronizing pulse Sy 1 respectively. Relationship between the respective pulses Sy 1, Sy 6, Sy 25, $\overline{\text{Sy 25}}$ are illustrated in FIGS. 6 (C) through 6 (*f*). FIG. 6 (*a*) shows the channel time.

A sample and hold circuit 9*a* holds key address codes $N_1 - B_2$ in storage during one pulse period of the synchronizing pulse Sy 1 (i.e. 25 $\mu$s) and supplies these stored key address codes to the frequency information memory 10 until applications of a next pulse Sy 1. A sample hold circuit 9*b* likewise holds vibrato codes $V_1 - V_6$ and the depth signals $D_1$, $D_2$ in storage during one pulse period of the synchronizing pulse Sy 1 and supplies these signals to the vibrato information generator 11 until application of a next pulse Sy 1.

A first gate circuit 12*a* is composed of a plurality of AND circuits each of which receives, at one input thereof, a corresponding one of the bit outputs $F_1 - F_{14}$ of the frequency information memory 10 and, at the other input thereof, the synchronizing pulse Sy 6. A second gate circuit 12*b* is likewise composed of a plurality of AND circuits each of which receives at one input thereof, a corresponding one of the bit outputs $V_{x1} - V_{x11}$ of the vibrato information generator 11. These gate circuits 12*a* and 12*b* supply, upon application thereto of the synchronizing pulse Sy 6, the frequency information $F_1 - F_{14}$ and the vibrato information $V_{x1} - V_{x11}$ to the multiplier 13 respectively as multiplicand inputs and multiplier inputs.

A third gate circuit 14 comprises AND circuits $A_{21} - A_{34}$ each of which receives at one input thereof a corresponding bit output of the multiplier 13 and at the other input thereof the synchronizing pulse Sy 25, AND circuits $A_{35} - A_{48}$ each of which receives at one input thereof a signal fed back from the final stage of a corresponding shift register of the output shift register group 15 and, at the other input thereof, the signal $\overline{\text{Sy 25}}$ which is of an opposite polarity to the synchronizing pulse Sy 25, and OR circuits $OR_5 - OR_{18}$ each of which receives the outputs of corresponding ones among the AND circuits $A_{21} - A_{34}$ and $A_{35} - A_{48}$. When the third gate circuit 14 receives the synchronizing pulse Sy 25, it applies signals $a_1 - a_{14}$ representing the results of the multiplication conducted in the multiplier 13 (i.e. frequency-modulated frequency information $F_{m1} - F_{m14}$) to the respective inputs of the shift registers of the output shift register group 15. When the synchronizing pulse Sy 25 is not applied to the third gate circuit 14, the output data of the shift register group 15 is circulated. Each shift register of the output shift register group 15 has 12 words (each word consisting of 14 bits) and is successively shifted by the clock pulse $\phi_1$.

The results of the multiplication for each channel (i.e. each key or tone) conducted in the multiplier 13 are sequentially output therefrom with an interval of 25 $\mu$s per channel (i.e. one key or one tone). Accordingly, it takes 300 $\mu$s before the results of the multiplication for all of the 12 channels have been output from the multiplier 13. In other words, the results of the multiplication for the respective channels stored in the output shift register group 15 are rewritten by the outputs of the multiplier 13 every 300 $\mu$s. Furthermore, the output shift register group 15 sequentially supplies the results of the multiplication for the respective channels (i.e. the frequency information $F_{m1} - F_{m14}$) to the fraction and integer counters 5*a* – 5*c* with an interval of 1 $\mu$s per channel, thereby enabling a time-sharing control of the instrument.

IV. GENERATION OF THE VIBRATO CODE

Figure 7:
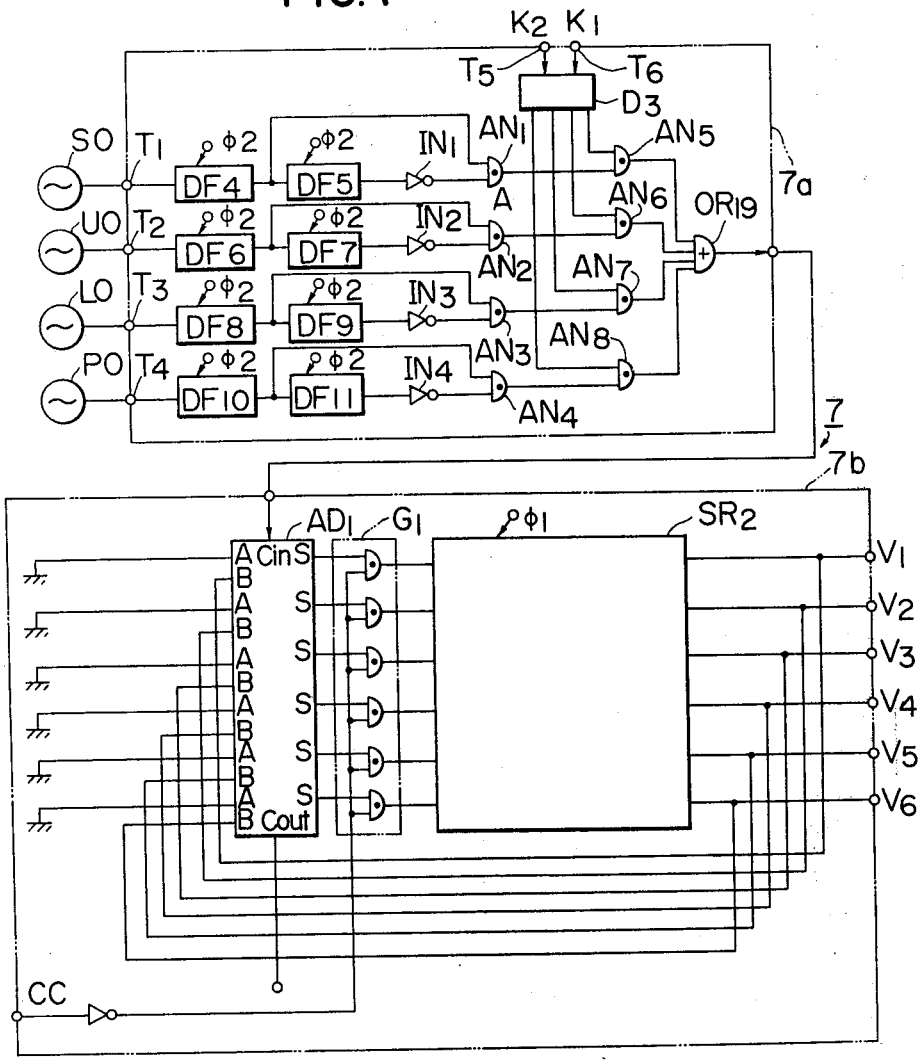
FIG. 7 is a circuit diagram showing a detailed logical circuit of a vibrato code generator 7 shown in FIG. 1.

Before explaining about the operation of the frequency information generator 4, generation of the vibrato codes $V_1 - V_6$ and the depth signals $D_1$ $D_2$ will be described with reference to FIGS. 7 and 8.

The vibrato code generator 7 comprises a clock select circuit 7*a* and a vibrato counter 7*b*. The clock select circuit 7*a* produces clock pulses to be applied to the vibrato counter 7*b*. In the embodiment shown in the figure, the clock select circuit 7*a* is constructed in such a manner that a clock pulse of the frequency corresponding to the kind of keyboard is selected and applied to the vibrato counter 7*b*.

Signals of selected frequencies and of a suitable waveshape (e.g. a rectangular wave) are respectively supplied from a solo keyboard signal oscillator SO, an upper keyboard signal oscillator UO, a lower keyboard signal oscillator LO and a pedal keyboard signal oscillator PO to their corresponding terminals $T_1 - T_4$. The values of these frequencies are determined in accordance with the period, i.e. the frequency variations, of a desired vibrato. For example, vibrato with frequency of 7Hz for the solo keyboard is obtained from the vibrato counter of 64 stages by rewriting the values of the vibrato codes $V_1 - V_6$, $64 \times 7 = 448$ times per second. Accordingly, the required frequency of the solo keyboard signal oscillator SO is 448Hz. The frequencies of the other oscillators UO-PO are determined in a like manner and, as a result, each keyboard has a different period of vibrato.

An output signal 1 of the solo keyboard signal oscillator SO is applied to a delay flip-flop $DF_4$ via the terminal $T_1$. The delay flip-flop $DF_4$ produces a signal 1 upon application thereto of an initial key clock pulse $\phi_2$. This signal 1 is applied to an AND circuit $AN_1$ and also to a delay flip-flop $DF_5$. The output of the delay flip-flop $DF_5$ at this time is O and this signal O is inverted in an inverter $IN_1$ and thereafter is applied to the AND circuit AN as a signal 1, enabling the AND circuit $AN_1$. The AND circuit $AN_1$ therefore produces a signal 1. Then, when a key clock pulse $\phi_2$ is applied to the delay flip-flop $DF_5$, the output of the delay flip-flop $DF_5$ becomes a signal 1 and, accordingly, the AND circuit $AN_1$ produces a signal 0. Delay flip-flops $DF_6$ – $DF_{11}$, inverters $IN_2$ – $IN_4$ and AND circuits $AN_2$ – $AN_4$ operate in a like manner.

Accordingly, pulse signals having a pulse width of one key time (12 $\mu$s) are produced from the AND circuits $AN_1$ – $AN_4$ from the time when the outputs of the oscillators SO – PO have changed from 0 to 1 and in response to the key clock pulse $\phi_2$. The periods of these pulse signals correspond to the frequencies of the respective oscillators. This is because the maximum number of musical tones to be reproduced simultaneously is 12 in the present embodiment.

The output corresponding to the keyboard of the depressed key is selected from the outputs of the AND circuits $AN_1$ – $AN_4$. The keyboard codes $K_1$ and $K_2$ are applied to a decoder $D_3$ via terminals $T_5$ and $T_6$ and a signal 1 is produced on the output line corresponding to the keyboard. A signal representing the solo keyboard SO is applied to the AND circuit $AN_5$, one representing the upper keyboard UO to the AND circuit $AN_6$, one representing the lower keyboard LO to the AND circuit $AN_7$ and one representing the pedal keyboard PO to the AND circuit $AN_8$, respectively. The AND circuits $AN_5$ – $AN_8$ also receive the output of the AND circuits $AN_1$ – $AN_4$ and, when one of these AND circuits $AN_5$ – $AN_8$ is enabled, a signal 1 (a clock pulse for producing a desired vibrato) is applied to an adder $AD_1$ of the vibrato counter *7b* through an OR circuit $OR_{19}$.

The vibrato counter *7b* comprises the adder $AD_1$, a shift register $SR_2$ of 12 words (1 word being composed of 6 bits) and a gate circuit $G_1$. The results of the addition conducted by the adder $AD_1$ are supplied to a corresponding channel of the shift register $SR_2$ every one key time. More specifically, the adder $AD_1$ adds together the outputs of the shift register $SR_2$ and the clock pulse applied from the clock select circuit *7a* and supplies the results of the addition to the shift register $SR_2$ via the gate circuit $G_1$. Accordingly, the counted value for each channel is binary data of 6 bits and the counting from 0 to 63 is repeated in accordance with application of the clock pulse from the clock select circuit *7a*. It will be understood that the period of this repeated counting corresponds to the frequencies of the oscillators SO – PO and therefore is different dependent upon the kind of keyboard.

The outputs of the vibrato counter *7b* are applied to the frequency information generator 4 as the vibrato codes $V_1$ – $V_6$ respectively having addresses ranging from 0 to 63. A clear signal cc is applied to the gate circuit G for resetting the counted value of the particular channel.

V. VIBRATO DEPTH CONTROL BY EACH KEYBOARD

Figure 8:
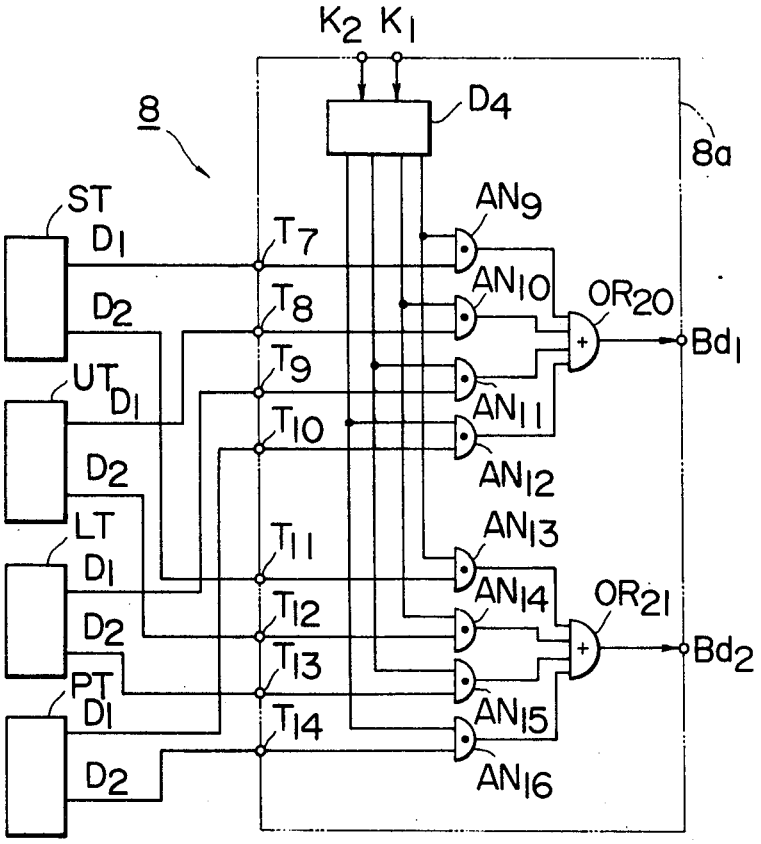
FIG. 8 is a circuit diagram showing a detailed circuit diagram of a vibrato adjustor 8 shown in FIG. 1.

Referring to FIG. 8, the vibrato adjustor 8 comprises tablet portions ST, UT, LT and PT which are provided on a panel disposed above the keyboards for adjusting vibrato depth (i.e. the rate of frequency variations) by each keyboard, and a data select circuit 8*a*. The tablet portions ST – PT are capable of adjusting vibrato depth in a suitable number of stages, i.e. four as in the present embodiment and producing binary data $D_1$ and $D_2$ corresponding to the respective stages. If no vibrato effect is required, the output binary data $D_2$, $D_1$ is 00, which is named "depth 0." If a slight degree of vibrato is desired, the binary data $D_2$, $D_1$ is 01, which is named "depth 1." The state of the binary data $D_2$, $D_1$ for a next degree of vibrato is 10, which is named "depth 2." The state of the binary data $D_2$, $D_1$ at the largest rate of frequency variation is 11, which is named "depth 3."

The output $D_1$ of the less significant digit of each tablet is applied to one of the input terminals of corresponding AND circuit among AND circuit $AN_9$ – $AN_{12}$ via a corresponding terminal among terminals $T_7$ – $T_{10}$. The output $D_2$ of the more significant digit of each tablet is applied to one of the input terminals of a corresponding AND circuit among AND circuits $AN_{13}$ – $AN_{16}$ via a corresponding terminal among terminals $T_{11}$ – $T_{14}$. Output lines of a decoder $D_4$ each of which is allotted for one of the keyboards are connected to the other input terminals of their corresponding AND circuits $AN_9$ – $AN_{16}$.

If, for example, the keyboard codes $K_1$, $K_2$ applied to the decoder $D_4$ represents the solo keyboard, the AND circuits $AN_9$ and $AN_{13}$ are enabled and signals from the solo keyboard tablet ST are output from the data select circuit 8*a* as depth signals $Bd_1$, $Bd_2$ via OR circuits $OR_{20}$ and $OR_{21}$. The depth signals $Bd_1$ and $Bd_2$ corresponding to the other keyboards are likewise output from the data select circuit 8*a* in response to the keyboard codes $K_1$, $K_2$.

If the control of vibrato depth or vibrato period by each keyboard is not necessary, provision of the data select circuit 8*a* or the clock select circuit *7a* will not be required. It should be noted, however, that individual controlling of the vibrato effect by each keyboard which has been considered difficult in the conventional analog type electronic musical instrument owing to requirement of an extremely complicated circuit construction can be realized by a very simple construction as described above.

An example of generation of frequency-modulated frequency information $Fm_1$ – $Fm_{14}$ will be described hereinbelow.

VI. GENERATION OF THE VIBRATO INFORMATION

First, generation of the vibrato information $V_{x1}$ – $V_{x11}$ will be described with reference to FIG. 9. The vibrato information $V_{x1}$ – $V_{x11}$ is established at such values that the frequency variation of a musical tone to be reproduced when the depth signals $B_1$, $B_2$ are at a maximum value takes place within a range between the order of +25 cents and −25 cents. One cent is an interval of one hundredth of demiton. A frequency ratio (1.059 ) between adjacent notes such as $C_1$ and $C_1^{\#}$ or $E_5$ and $F_5$ consists of 100 cents, and one hundredth of this frequency ratio is one cent. The vibrato information $V_{x1} - V_{x11}$ is divided into an integer section and a fraction section. $V_{x11}$ which corresponds to the most significant digit is allotted to the integer section and the rest of the information is allotted to the fraction section. In case the integer section $V_{x11}$ is 1 and the fraction section is 0, the ratio of frequency variation is 1, which signifies that there is no frequency variation at all. The vibrato informatin $V_{x1} - V_{x11}$ is established at such a value that it varies periodically by several cents in the positive and negative directions from the ratio 1. The vibrato information $V_{x1} - V_{x11}$ is expressed in the form of a function with the vibrato code $V_1 - V_6$ used as a variable, as has previously been described.

Figure 9:
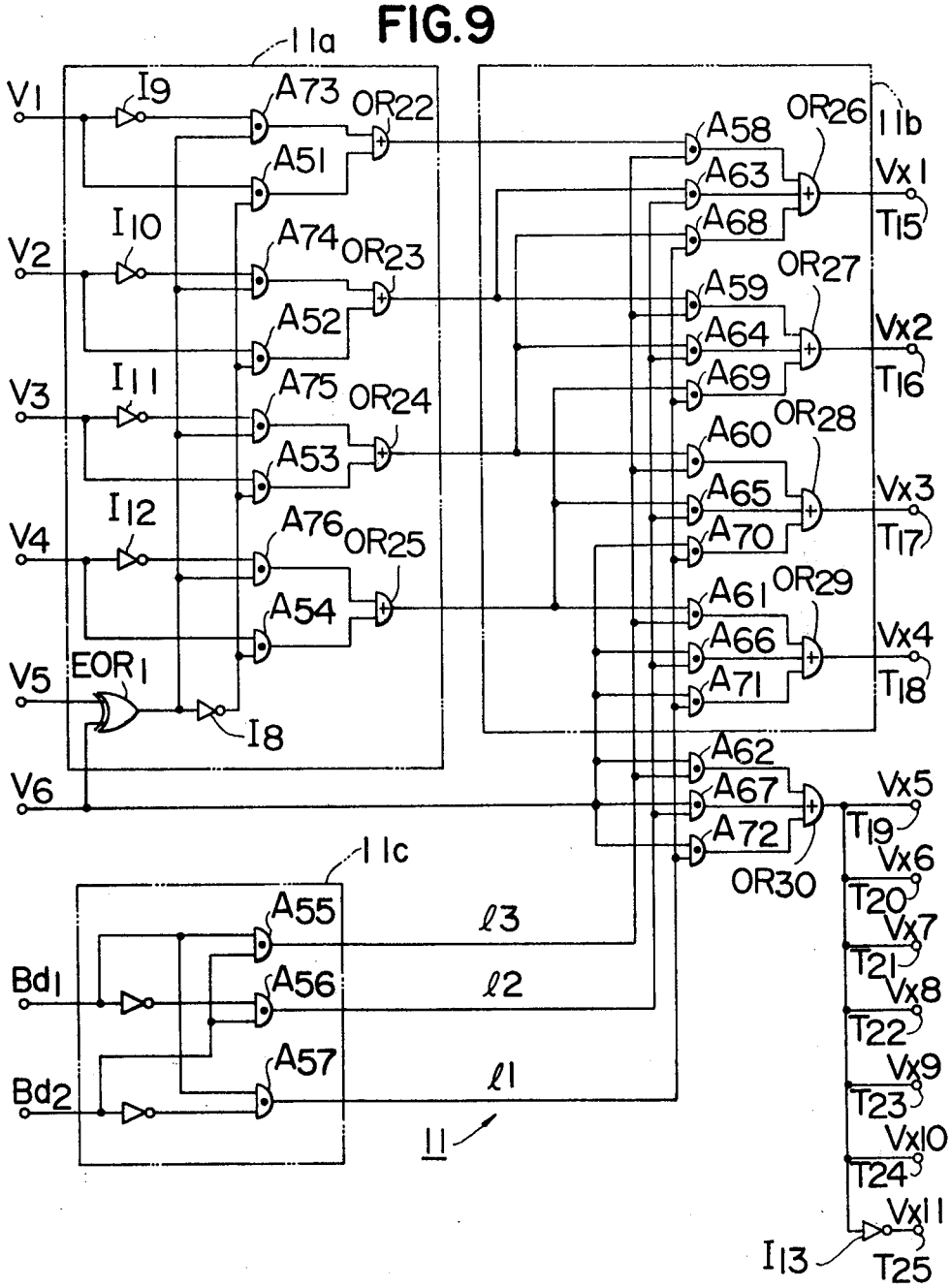
FIG. 9 is a circuit diagram showing a detailed logic circuit of a vibrato information generator 11 shown in FIG. 5.
Figure 10:
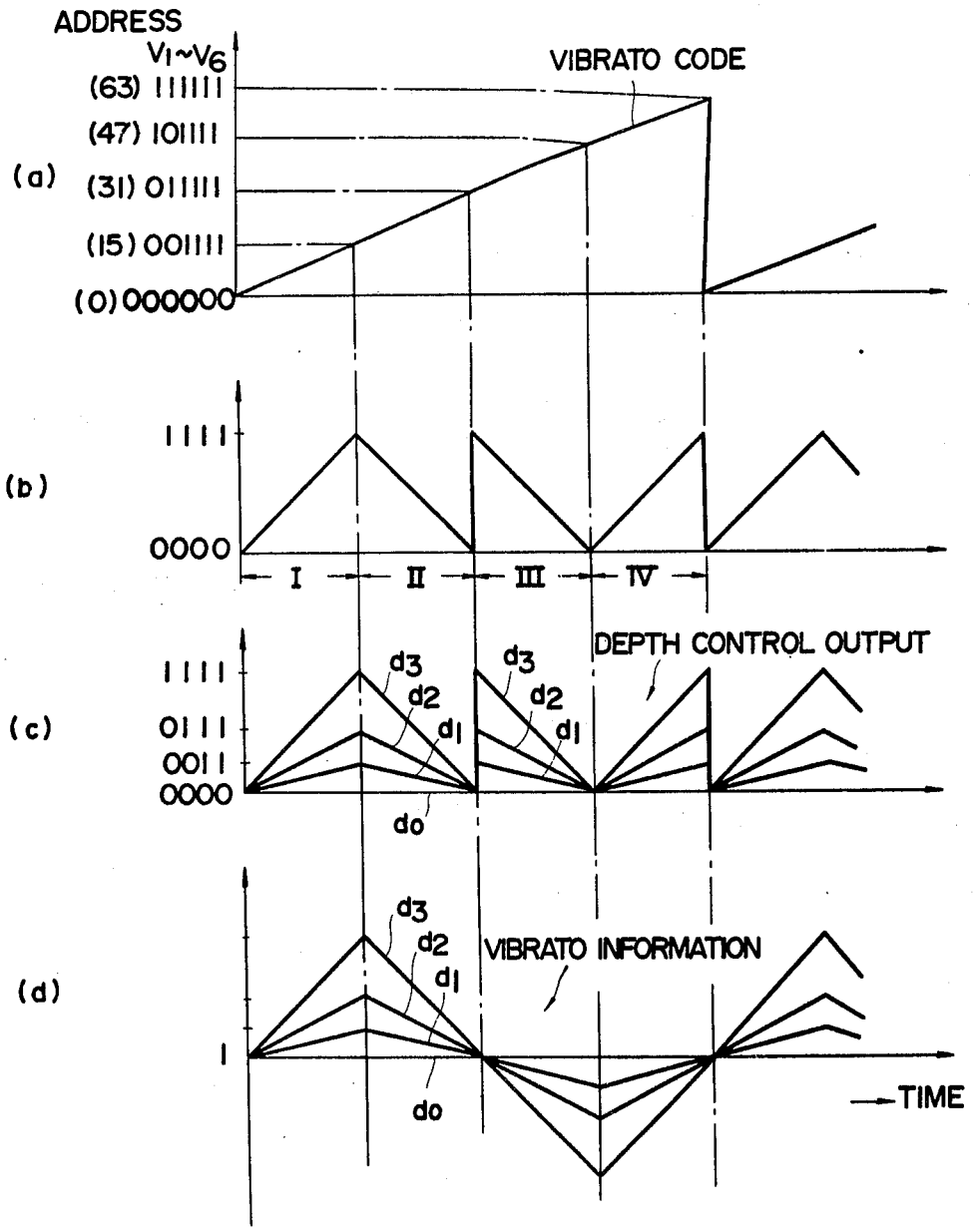
FIG. 10(*a*) is a graphic diagram showing change of a vibrato code in relation to time.

In the embodiment shown in FIG. 9, this function is established so that the vibrato information $V_{x1} - V_{x11}$ produced in response to the vibrato code $V_1 - V_6$ will have a triangular waveshape. A triangular wave conversion circuit 11*a* is provided for producing vibrato information of the less significant digits upon receipt of the vibrato codes $V_1 - V_6$. Referring to FIG. 10(*a*), at the addresses 0 – 15 of the periodically changing vibrato, the less significant digits $V_1 - V_4$ of the vibrato information are directly output as shown in the region I in FIG. 10 (*b*). If the addresses are 16 – 31, inverted signals of the less significant digits $V_1 - V_4$ are output as shown in the region II. The inversion is effected by inverters $I_9 - I_{12}$. At the addresses 32 – 47, inverted signals of the less significant digits $V_1 - V_4$ are output as shown in the region III. At the addresses 48 – 63, the less significant digits $V_1 - V_4$ are directly output as shown in the region IV.

In the triangle wave conversion circuit 11*a*, an exclusive OR circuit $EOR_1$ controls inversion of the less significant digits $V_1 - V_4$ of the vibrato code. The exclusive OR circuit $EOR_1$ receives as its input the more significant digits $V_5$ and $V_6$. In the region I, the more significant digits $V_5$ and $V_6$ are 00, so that the output of the exclusive OR circuit $EOR_1$ is 0, and the inverter $I_8$ produces a signal 1. This signal 1 is applied to one input terminal of AND circuits $A_{51} - A_{54}$. This enables the AND circuits $A_{51} - A_{54}$ thereby causing these AND circuits to gate out the less significant digits $V_1 - V_4$. These outputs of the AND circuits $A_{51} - A_{54}$ are applied to a depth adjustment circuit 11*b* via OR circuits $OR_{22} - OR_{25}$.

The depth signals $Bd_1$ and $Bd_2$ which are used as coefficients in a function for producing the vibrato information $V_{x1} - V_{x11}$ are decoded in a decoder 11*c* and thereafter are applied to the depth adjustment circuit 11*b*. The decoded depth signals $Bd_1$ and $Bd_2$ are multiplied with the less significant digits of the vibrato information output from the triangular wave conversion circuit 11*a* in the depth adjustment circuit 11*b*. The outputs of the depth adjustment circuit 11*b* are varied as shown in FIG. 10(*c*) in which reference character $d_3$ denotes "depth 3," $d_2$ "depth 2" and do "depth 0" respectively.

If the depth signals $Bd_2$, $Bd_1$ are 11, an AND circuit $A_{55}$ of the decoder 11*c* is enabled to produce a signal 1 on an output line $l_3$ provided for "depth 3." If the depth signals $Bd_2$, $Bd_1$ are 10, an AND circuit $A_{56}$ is enabled to produce a signal 1 on an output line $l_2$ provided for "depth 2." If the depth signals $Bd_2$, $Bd_1$ are 01, an AND circuit $A_{57}$ is enabled to produce a signal 1 on an output line $l_1$ provided for "depth 1." If the depth signals $Bd_2$, $Bd_1$ are 00, a signal 0 is produced on all of the output lines $l_1 - l_3$.

The output line $l_3$ is connected to AND circuits $A_{58} - A_{62}$ of the depth adjustment circuit 11*b*, the output line $l_2$ to AND circuits $A_{63} - A_{67}$ and the output line $l_1$ to AND circuits $A_{68} - A_{72}$.

Assume that a signal 1 is produced on the output line $l_3$. The outputs of the OR circuits $OR_{22} - OR_{25}$ are provided at output terminals $T_{15} - T_{18}$ of the vibrato information generator 11 via the AND circuits $A_{58} - A_{62}$ and the OR circuits $OR_{26} - OR_{29}$. At the addresses 0 – 15 (the region I), the less significant digits $V_1 - V_4$ of the vibrato code become the less significant digits $V_{x1} - V_{x4}$ of the vibrato information without inversion of the signal, as shown in Table II. The more significant digits $V_{x5} - V_{x11}$ of the vibrato information is formed from the most significant digit $V_6$ of the vibrato code as will be described later.

Table II

| Vibrato codes | | | | | | | Vibrato information (depth 3) | | | | | | | | | | |
|---|---|---|---|---|---|---|---|---|---|---|---|---|---|---|---|---|---|
| Address | $V_6$ | $V_5$ | $V_4$ | $V_3$ | $V_2$ | $V_1$ | 11 | 10 | 9 | 8 | 7 | 6 | 5 | 4 | 3 | 2 | 1 |
| 0 | 0 | 0 | 0 | 0 | 0 | 0 | 1 | 0 | 0 | 0 | 0 | 0 | 0 | 0 | 0 | 0 | 0 |
| 1 | 0 | 0 | 0 | 0 | 0 | 1 | 1 | 0 | 0 | 0 | 0 | 0 | 0 | 0 | 0 | 0 | 1 |
| . | | | . | | | | . | | | . | | | | | | | |
| . | | | . | | | | . | | | . | | | | | | | |
| . | | | . | | | | . | | | . | | | | | | | |
| 14 | 0 | 0 | 1 | 1 | 1 | 0 | 1 | 0 | 0 | 0 | 0 | 0 | 0 | 1 | 1 | 1 | 0 |
| 15 | 0 | 0 | 1 | 1 | 1 | 1 | 1 | 0 | 0 | 0 | 0 | 0 | 0 | 1 | 1 | 1 | 1 |
| 16 | 0 | 1 | 0 | 0 | 0 | 0 | 1 | 0 | 0 | 0 | 0 | 0 | 0 | 1 | 1 | 1 | 1 |
| 17 | 0 | 1 | 0 | 0 | 0 | 1 | 1 | 0 | 0 | 0 | 0 | 0 | 0 | 1 | 1 | 1 | 0 |
| . | | | . | | | | . | | | . | | | | | . | | |
| . | | | . | | | | . | | | . | | | | | . | | |
| . | | | . | | | | . | | | . | | | | | . | | |
| 30 | 0 | 1 | 1 | 1 | 1 | 0 | 1 | 0 | 0 | 0 | 0 | 0 | 0 | 0 | 0 | 0 | 1 |
| 31 | 0 | 1 | 1 | 1 | 1 | 1 | 1 | 0 | 0 | 0 | 0 | 0 | 0 | 0 | 0 | 0 | 0 |
| 32 | 1 | 0 | 0 | 0 | 0 | 0 | 0 | 1 | 1 | 1 | 1 | 1 | 1 | 1 | 1 | 1 | 1 |
| 33 | 1 | 0 | 0 | 0 | 0 | 1 | 0 | 1 | 1 | 1 | 1 | 1 | 1 | 1 | 1 | 1 | 0 |
| . | | | . | | | | . | | | . | | | | | . | | |
| . | | | . | | | | . | | | . | | | | | . | | |
| . | | | . | | | | . | | | . | | | | | . | | |
| 46 | 1 | 0 | 1 | 1 | 1 | 0 | 0 | 1 | 1 | 1 | 1 | 1 | 1 | 0 | 0 | 0 | 1 |
| 47 | 1 | 0 | 1 | 1 | 1 | 1 | 0 | 1 | 1 | 1 | 1 | 1 | 1 | 0 | 0 | 0 | 0 |
| 48 | 1 | 1 | 0 | 0 | 0 | 0 | 0 | 1 | 1 | 1 | 1 | 1 | 1 | 0 | 0 | 0 | 0 |
| 49 | 1 | 1 | 0 | 0 | 0 | 1 | 0 | 1 | 1 | 1 | 1 | 1 | 1 | 0 | 0 | 0 | 1 |
| . | | | . | | | | . | | | . | | | | | . | | |
| . | | | . | | | | . | | | . | | | | | . | | |
| . | | | . | | | | . | | | . | | | | | . | | |
| 62 | 1 | 1 | 1 | 1 | 1 | 0 | 0 | 1 | 1 | 1 | 1 | 1 | 1 | 1 | 1 | 1 | 0 |

Table II-continued

| Vibrato codes | | | | | | | Vibrato information (depth 3) | | | | | | | | | | |
|---|---|---|---|---|---|---|---|---|---|---|---|---|---|---|---|---|---|
| Address | $V_6$ | $V_5$ | $V_4$ | $V_3$ | $V_2$ | $V_1$ | 11 | 10 | 9 | 8 | 7 | 6 | 5 | 4 | 3 | 2 | 1 |
| 63 | 1 | 1 | 1 | 1 | 1 | 1 | 0 | 1 | 1 | 1 | 1 | 1 | 1 | 1 | 1 | 1 | 1 |

At the addresses 16 – 31 (the region II), the more significant digits $V_5$, $V_6$ of the vibrato code are 1, 0. The exclusive OR circuit $EOR_1$ produces a signal 1 which is applied to the AND circuits $A_{73} - A_{76}$. Accordingly, the less significant digits $V_1 - V_4$ are inverted by inverters $I_9 - I_{12}$ and the inverted signals are produced from the OR circuits $OR_{22} - OR_{25}$ via the AND circuits $A_{73} - A_{76}$. Accordingly, the vibrato information portion $V_{x1} - V_{x4}$ provided at the terminals $T_{15} - T_{18}$ consists of the inverted signals of the vibrato code portion $V_1 - V_4$.

At the addresses 32 – 47 (the region III), the vibrato information $V_{x1} - V_{x4}$ is formed by the inverted signals of the vibrato code portion $V_1 - V_4$ and the addresses 46 – 63 (the region IV), the vibrato code portion $V_1 - V_4$ is directly provided as the vibrato information portion $V_{x1} - V_{x4}$.

If "depth 2" is selected, a signal 1 is applied from the line $l_2$ to the AND circuits $A_{63} - A_{67}$. In the meantime, the output of the OR circuit $OR_{23}$ is provided at the terminal $T_{15}$ via the AND circuit $A_{63}$ and the OR circuit $OR_{26}$, the output of the OR circuit $OR_{24}$ at the terminal $T_{16}$ via the AND circuit $A_{64}$, and the output of the OR circuit $OR_{25}$ at the terminal $T_{17}$ via the AND circuit $A_{65}$. Accordingly, a value of the less significant digits $V_{x1} - V_{x3}$ of the vibrato information in "depth 2" is equivalent to a value obtained by shifting down the less significant digits $V_{x2} - V_{x4}$ of the vibrato information in "depth 3" shown in Table II by one digit.

In case of "depth 1", a signal 1 is applied to the AND circuits $A_{68} - A_{72}$. The output of the OR circuit $OR_{24}$ is provided at the terminal $T_{15}$ via the AND circuit $A_{68}$, the output of the OR circuit $OR_{25}$ at the terminal $T_{16}$ via the AND circuit $A_{69}$. Accordingly, a value of the less significant digits $V_{x1} - V_{x2}$ of the vibrato information is equivalent to a value obtained by shifting down the less significant digits $V_{x3} - V_{x4}$ of the vibrato information in "depth 3" shown in Table II by two digits.

The more significant digits $V_{x5} - V_{x11}$ of the vibrato information ($V_{x4} - V_{x11}$ in case of "depth 2" and $V_{x3} - V_{x11}$ in case of "depth 1") are formed from the most significant digit $V_6$ of the vibrato code. The most significant digit $V_6$ is a signal 0 at the addresses 0 – 31 (the regions I, II) and a signal 1 at the addresses 32–63 (the regions III, IV). The value of the more significant digits is determined in such a manner that the vibrato information $V_{x1} - V_{x11}$ will vary in the positive direction from the above described ratio 1 in case $V_6$ is 0 and in the negative direction in case $V_6$ is 1. FIG. 10(*d*) shows the vibrato information $V_{x1} - V_{x11}$ provided in the foregoing manner at the output terminals $T_{15} - T_{25}$. It will be noted that te vibrato information is a function with the vibrato code (FIG. 10(*a*)) being used as a variable. Reference characters $d_3$ denotes "depth 3," $d_2$ "depth 2," $d_1$ "depth 1" and $d_0$ "depth 0" respectively.

If the most significant digit $V_6$ is 0 in "depth 3," the output of the OR circuit $OR_{30}$ is 0. Accordingly, a signal 1 is produced at a terminal $T_{25}$ via an inverter $I_{13}$ and a signal 0 at terminals $T_{19} - T_{24}$. At the addresses 32 – 63, $V_6$ is 1 and a signal 1 is produced at the terminals $T_{19} - T_{24}$ via the AND circuit $A_{62}$, while a signal 0 is produced at the terminal $T_{25}$. Thus, vibrato information $V_{x1} - V_{x11}$ of a triangular waveshape $d_3$ in FIG. 10(*d*) is produced with a value shown in Table II.

In case of "depth 2," $V_6$ is applied to the AND circuits $A_{66}$ and $A_{67}$ and the more significant digits $V_{x4} - V_{x10}$ of the vibrato information.

In case of "depth 1," $V_6$ is applied to the AND circuits $A_{70} - A_{72}$ and the more significant digits $V_{x3} - V_{x10}$ of the vibrato information.

In case of "depth 0" ($Bd_2$, $Bd_1 = 00$), the digits $V_{x1} - V_{x10}$ of the vibrato information are all 0 and the digit $V_{x11}$ is 1.

Referring to Table II, a maximum value of the vibrato information is obtained at the addresses 15 and 16. This maximum value signifies the largest ratio of frequency variation which is 1.0146 in a decimal notation. This ratio provides the basic frequency information $F_1 - F_{14}$ with a frequency variation of about +25 cents. A minimal value of the vibrato information is produced at the addresses 47 and 48. This is 0.9844 in a decimal notation signifying that the basic frequency information $F_1 - F_{14}$ is provided with a frequency variation of about −27 cents.

The vibrato information $V_{x1} - V_{x11}$ is applied to the multiplier 13 where it is multiplied with the basic frequency information.

VII. MULTIPLIER

Figure 11:
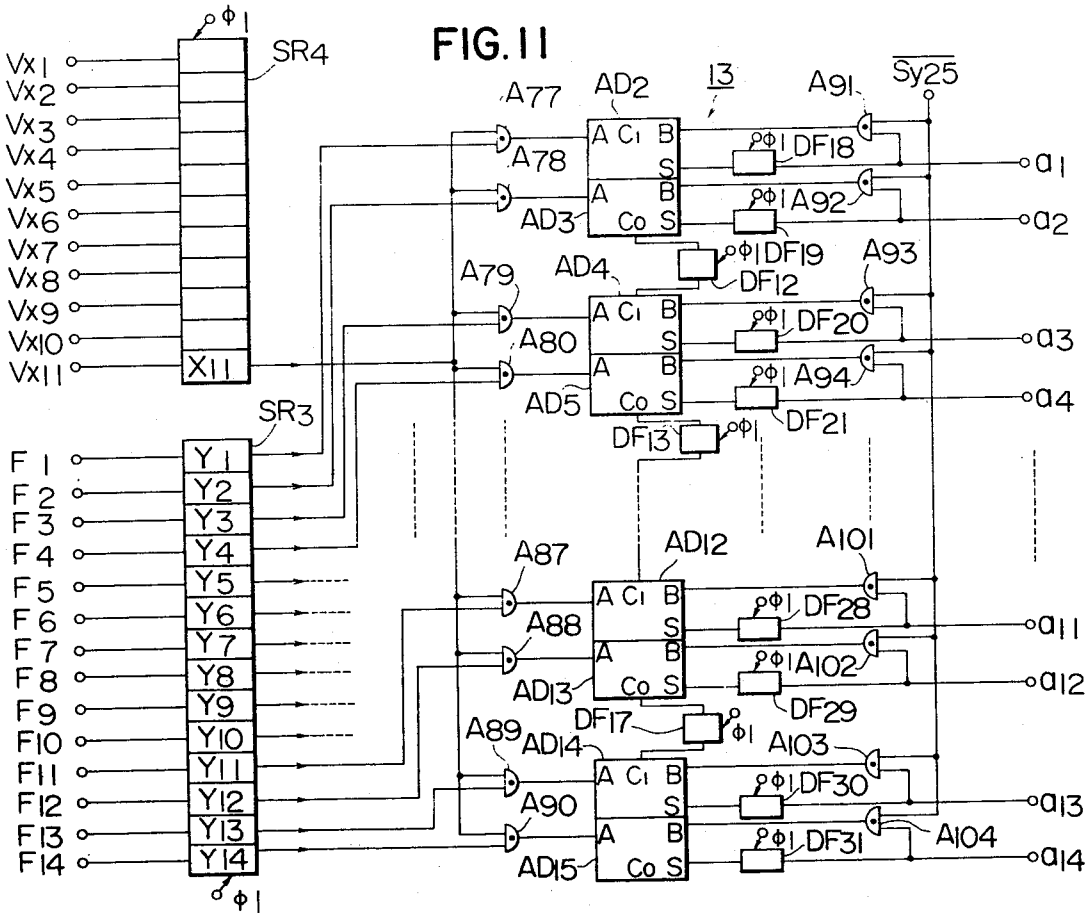
FIG. 11 is a circuit diagram showing a detailed logical circuit of a multiplier 13 shown in FIG. 5.

FIG. 11 is a circuit diagram showing an example of the multiplier 13. A multiplicand shift register $SR_3$ consists of a shift register of a parallel-input-parallel output type. When the synchronizing pulse Sy6 is applied to the first gate circuit 12*a*, the basic frequency information $F_1 - F_{14}$ is supplied from the first gate circuit 12*a* to the multiplicand shift register $SR_3$ andd stored therein. The value of the basic frequency information is sequentially shifted from the most significant digit toward the least significant digit in response to the clock pulse $\phi_1$. A multiplier shift register $SR_4$ consists of a shift register of a parallel-input-series-output type to which the vibrato information $V_{x1} - V_{x11}$ is supplied from the second gate circuit 12*b*. The value of the stored vibrato information $V_{x1} - V_{x11}$ is sequentially shifted from the least significant digit toward the most significant digit in response to the clock pulse $\phi_1$ and an output is produced from the most significant digit.

Outputs $Y_1 - Y_{14}$ of the multiplicand shift register $SR_3$ are respectively applied to AND circuits $A_{77} - A_{90}$. An output $X_{11}$ of the multipler shift register $SR_4$ is also applied to the AND circuits $A_{77} - A_{90}$. The outputs of the AND circuit $A_{77} - A_{90}$.are applied to input terminals A of adders $AD_2 - AD_{15}$. Outputs from output terminals S of the adders $AD_2 - AD_{15}$ are delayed by 1 $\mu$s in delay flip-flops $DF_{18} - DF_{31}$ and thereafter are fed back to input terminals B of the adders $AD_2 - AD_{15}$ through AND circuits $A_{91} - A_{104}$.

The inputs are applied to the terminals A and B every 1 $\mu$s in response to the clock pulse $\phi_1$, whereas it takes a longer time for a carry signal produced by a single addition to be transmitted from the adder $AD_2$ to the adder $AD_{15}$. Accordingly, it is possible that next inputs will be applied to the terminals A and B before the transmission of the carry signal is completed with a result that the carry signal will disappear on the way. Since the quickest response time of an ordinary 1-bit adder is 0.2 – 0.3 μs, and a carry signal must be transmitted through 14 adders at a maximum upon a single addition, carrying time of at least about 3 μs is required. For preventing occurence of such erroneous operation, delay flip-flops $DF_{12}$ – $DF_{17}$ are provided every two other adders to hold the carry signal for 1 μs and thereupon apply it to an input terminal $C_1$ of an adder of more significant digit. For example, a carry signal output terminal Co of the adder $AD_3$ is connected to the input terminal of the delay flip-flop $DF_{12}$ and the output terminal of the delay-flop $DF_{12}$ is connected to the carry signal input terminal $C_1$ of the adder $AD_4$. This arrangment ensures the transmission of the carry signal. The transmission of the carry signal, however, requires carrying time of 6 μs at the maximum. This carrying time is considered in determining the interval between the synchronizing pulses Sy 6 and Sy 25.

The vibrato information $V_{x1}$ – $V_{x11}$ stored in the multiplier shift register $SR_4$ at te application of the synchronizing pulse Sy 6 is output from the shift register $SR_4$ at a rate of one digit every 1 μs starting from the most significant digit $V_{x11}$. Alternatively stated, each digit of the multiplier is sequentially output from the shift register $SR_4$ and applied to one of the input terminals of the respective AND circuits $A_{77}$ – $A_{90}$. Since each digit of the multiplicand $Y_1$ – $Y_{14}$ is applied from the multiplicand shift register $SR_3$ to the other input terminals of the respective AND circuits $A_{77}$ – $A_{90}$, the AND circuits $A_{77}$ – $A_{90}$ produce logical products of the multiplicand $Y_1$ – $y_{14}$ and the output (a single numeral) of the shift register $SR_4$. These logical products are applied to the input terminals A of the respective adders $AD_2$ – $AD_{15}$. To the input terminals B of the adders $AD_2$ – $AD_{15}$ are also applied partial products from the delay flip-flops $DF_{18}$ – $DF_{31}$. The logical products and the partial products are added together in the adders $AD_2$ – $AD_{15}$ to form new partial products. These new partial products are output from the output terminals S of the adders $AD_2$ – $AD_{15}$ and supplied to the delay flip-flops $DF_{18}$ – $DF_{31}$. Simultaneously, a single numeral output which is one digit less significant than the preceding single numeral output is provided by the shift register $SR_4$, and the logical products of the multiplicand $Y_1$ – $Y_{14}$ and the output of the shift register $SR_4$ are applied to the input terminals A of the adders $AD_2$ – $AD_{15}$. These logical products are added to the partial products from the delay flip-flops $DF_{18}$ – $DF_{31}$. It should be noted that the multiplicand $Y_1$ – $Y_{14}$ is not always the same value but a value which is produced by shifting down the basic frequency information $F_1$ – $F_{14}$ stored at the application of the synchronizing pulse sy 6 every 1 μs. This is necessary because a single numeral shifted down by one digit is output every 1 μs from the multiplier shift register $SR_4$ and the digits of the inputs at the input terminals A (logical products) and the digits of the inputs at the input terminals (partial products) must coincide with each other.

As has been described in the foregoing, the logical product of a single numeral output of each digit of the multiplier and the multiplicand $Y_1$ – $Y_{14}$ shifted in accordance with this single numeral output is added to the partial product to form a new partial product and subsequent addition is repeated in the same manner. The instant at which the least significant digit $V_{x1}$ of the vibrato information is output from the multiplier shift register $SR_4$ is 11 μs after the application of the synchronizing pulse Sy 6 by which instant the addition of the inputs at A input terminals (logical products) to the inputs at B input terminals (partial products) has been completed. A carry signal produced upon completion of the addition is temporarily held in each of the delay flip-flops $DF_{12}$ – $DF_{17}$ and thereafter is applied to the input terminal $C_1$ of an adder of a more significant digit. In the adder to which the carry signal is applied, this carry signal is added to the iinput at the input terminal B. Since the carry signal is held in one of the flip-flops $DF_{12}$ – $DF_{17}$ for 1 μs, total time required for all of these flip-flops is 6 μs. When the addition of the carry signal has been completed, the sum in the adders is equal to a total product. Accordingly, the multiplication is completed in 17 μs after the application of the synchronizing pulse Sy 6. Outputs $a_1$ – $a_{14}$ from the adders $AD_2$ – $AD_{15}$ at this moment represent the total product of the multiplication, i.e. the result of the multiplication of the vibrato information $V_{x1}$ – $V_{x11}$ which is the multiplier and the basic frequency information $F_1$ – $F_{14}$ which is the multiplicand.

The outputs $a_1$ – $a_{14}$ are supplied to the output shift register group 15 and stored therein upon application of a synchronizing pulse Sy 25 which is produced 19 μs after the production of the synchronizing pulse Sy 6. At this time, a pulse $\overline{\text{Sy 25}}$ which has been applied to the AND circuits $A_{91}$ – $A_{104}$ becomes 0, so that the values in the adders $AD_2$ – $AD_{15}$ are cleared.

VIII. GENERATION OF FREQUENCY INFORMATION

Generation of the frequency information $F_{m1}$ – $F_{m14}$ will now be described with reference to FIGS. 5 and 6.

Assume that the synchronizing pulse Sy 1 is applied to the sample hold circuits 9*a* and 9*b* when the key address code $N_1$ – $K_2$ of the 1st channel is produced from the key assigner 3 as shown in FIG. 6(*a*). The vibrato code $V_1$ – $V_6$ and the depth signals $Bd_1$, $Bd_2$ at this time are also information of a keyboard corresponding to the key address code $N_1$ – $K_2$ of the 1st channel. In response to such information the vibrato information $V_{x1}$ – $V_{x11}$ is produced in the vibrato information generator 11 and the basic frequency information $F_1$ – $F_{14}$ is read from the frequency information memory 10. Since the first and second gate circuits 12*a*, 12*b* are enabled by the synchronizing pulse Sy 6, the production of the vibrato information $V_{x1}$ – $V_{x11}$ and the reading of the basic frequency information $F_1$ – $F_{14}$ is performed within 5 μs as shown in FIG. 6 (*g*). This arrangement ensure sufficient response time for the frequency information memory 10 and the vibrato information generator 11. As a result, a read-only memory of a low operation speed may effectively be used in the frequency information memory 10 and, accordingly, the frequency information generator 11 can be made compact and manufactured at a relatively low cost.

Upon application of the synchronizing pulse Sy 6, the vibrato information $V_{x1}$ – $V_{x11}$ is stored in the multiplier shift register $SR_4$ and the basic frequency information $F_1$ – $F_{14}$ in the multiplicand shift register $SR_3$. Shifting of the multiplier $V_{x1}$ – $V_{x11}$ is completed 12 μs later as shown in FIG. 6 (*h*). Since, however, the carry signal is held in each of the six delay flip-flops $DF_{12}$ – $DF_{17}$ and requires 6 $\mu$s for carrying as shown in FIG. 11 ($i$), the multiplication is completed after further lapse of 6 $\mu$s.

Upon application of the synchronizing pulse Sy 25, the output $a_1 - a_{14}$ are applied to the output shift register 15 via the third gate circuit 14. These outputs $a_1 - a_{14}$ represent the result of the multiplication of the basic frequency information $F_1 - F_{14}$ of the first channel and the vibrato information $V_{x1} - V_{x11}$ of the first channel and therefore constitute frequency-modulated frequency information. Accordingly, the frequency information $F_{m1} - F_{m14}$ of the 1st channel is stored in the output shift register 15. The frequency-information $F_{m1} - F_{m14}$ is output from the output shift register 15 12 $\mu$s later. The output of the output shift register 15 is supplied to the counters 5$a$ – 5$c$ and simultaneously fed back to the output shift register 15. Subsequent frequency information $F_{m1} - F_{m14}$ is applied to the counters 5$a$ – 5$c$ in a like manner at every 1 key time.

When a next synchronizing pulse Sy 1 is produced as shown in FIG. 6($c$), information of the 2nd channel is applied to the sample hold circuits 9$a$, 9$b$ as shown in FIG. 6($a$). Thus, the frequency-modulated frequency information $F_{m1} - F_{m14}$ of the 2nd channel is stored in the corresponding channel of the output shift register 15. Subsequently, at every application of the synchronizing pulse Sy 1 (with a period of 25 $\mu$s), the vibrato information $V_{x1} - V_{x11}$ and the basic frequency information $F_1 - F_{14}$ of subsequent channels are sequentially multiplied with each other and the result of the multiplications, i.e. the frequency information $F_{m1} - F_{m14}$, is successively stored in the corresponding channels of the output shift register 15 upon application of the synchronizing pulse Sy 25. Since the maximum number of musical tones to be reproduced simultaneously is 12, a period with which the frequency information $F_{m1} - F_{m14}$ of a particular channel is stored in the output shift register 15 is 25 $\mu$s $\times$ 12 = 300 $\mu$s. Accordingly, data of the same value is cyclically output from the corresponding channel of the output shift register 15 during at least 300 $\mu$s. This does not have any adverse effect on the production of the vibrato effect, because if, for example, production of vibrato effect with a period of 7 Hz is desired, the data may be rewritten 448 times per second with a rewriting period of about 2 ms.

Table III shows an example of the frequency information $F_{m1} - F_{m14}$ output from the output shift register 15 with respect to the note $C_2$. In the table, the data is expressed in a decimal notation. The vibrato information $V_{x1} - V_{x11}$ is one in "depth 3" ($Bd_2$, $Bd_1 = 11$) and corresponds to the binary data of the vibrato information $V_{x1} - V_{x11}$ shown in Table II.

Table III

| Basic frequency ($C_2$) $F_1$–$F_{14}$ | $V_1$–$V_6$ address | Vibrato information $V_{x1}$–$V_{x11}$ | Frequency information $F_{m1}$–$F_{m14}$ |
|---|---|---|---|
| | 0 | 1.0000 | 0.10465 |
| | 1 | 1.0009 | 0.10474 |
| | 2 | 1.0019 | 0.10484 |
| | 3 | 1.0029 | 0.10495 |
| | . | . | . |
| | . | . | . |
| | . | . | . |
| | 13 | 1.0126 | 0.10596 |
| 0.10465 | 14 | 1.0136 | 0.10607 |
| | 15 | 1.0146 | 0.10617 |
| | 16 | 1.0146 | 0.10617 |
| | 17 | 1.0136 | 0.10607 |
| | . | . | . |
| | . | . | . |
| | . | . | . |
| | 30 | 1.0009 | 0.10474 |
| | 31 | 1.0000 | 0.10465 |

Table III-continued

| Basic frequency ($C_2$) $F_1$–$F_{14}$ | $V_1$–$V_6$ address | Vibrato information $V_{x1}$–$V_{x11}$ | Frequency information $F_{m1}$–$F_{m14}$ |
|---|---|---|---|
| | 32 | 0.9990 | 0.10454 |
| | 33 | 0.9980 | 0.10444 |
| | . | . | . |
| | . | . | . |
| | . | . | . |
| | 47 | 0.9844 | 0.10301 |
| | . | . | . |
| | . | . | . |
| | . | . | . |
| | 63 | 0.9990 | 0.10454 |

If the vibrato period is 7Hz, the value of the frequency information $F_{m1} - F_{m14}$ changes at every 2ms in correspondence to the respective addresses of the vibrato code $V_1 - V_6$. During this 2ms period the frequency information $F_{m1} - F_{m14}$ of the same value is repeatedly output from the output shift register 15 every 12 $\mu$s.

IX. GENERATION OF A MUSICAL TONE WAVESHAPE

Figure 12:
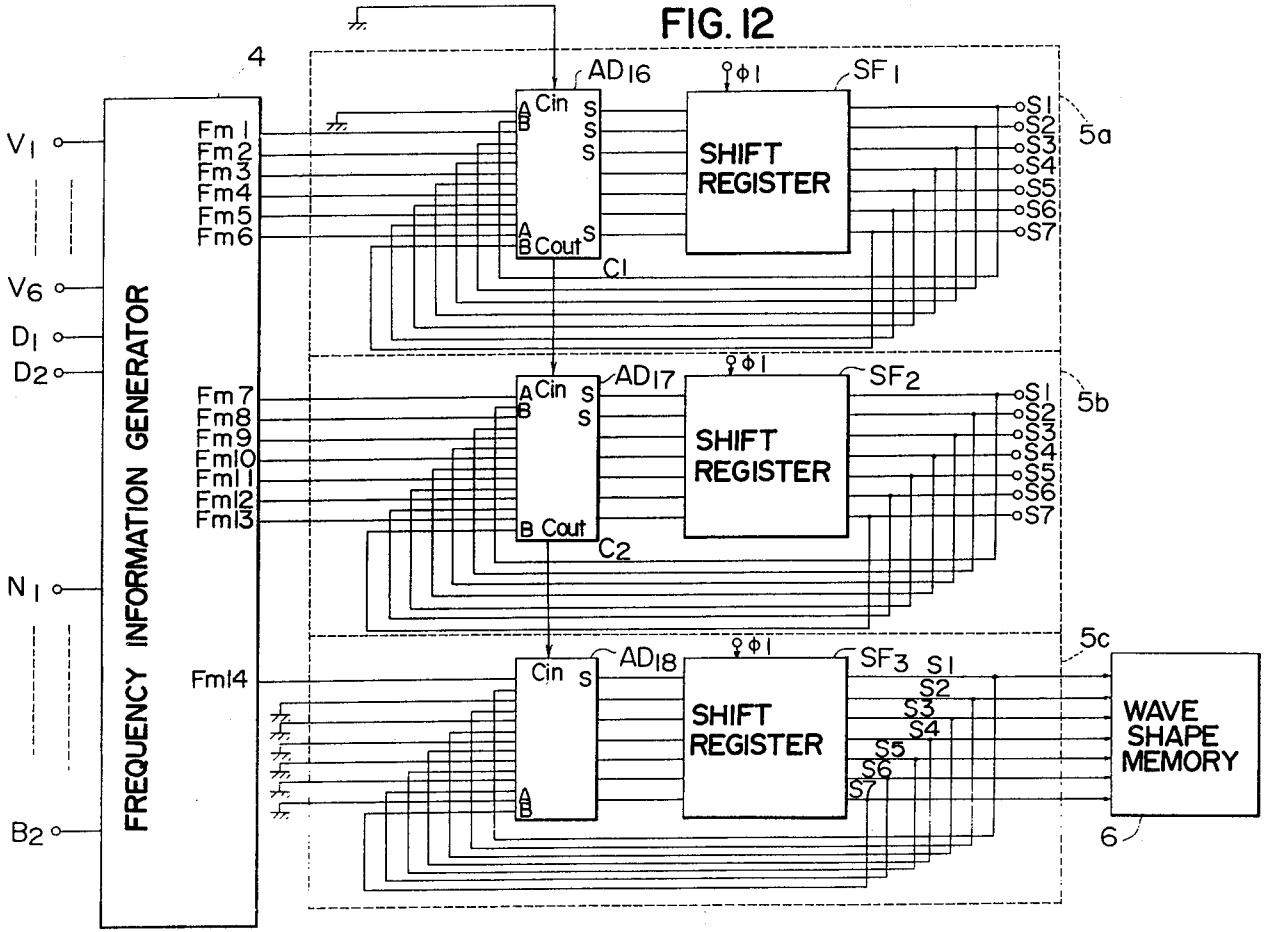
FIG. 12 is a block diagram showing in detail fraction counters 5*a*, 5*b* and an integer counter 5*c*.

The least significant digit up to the sixth digit of the frequency information $F_{m1} - F_{m14}$ are applied from the output shift register 15 to the fraction counter 5$a$, those from the seventh digit up to the thirteenth digit to the fraction counter 5$b$, and the most significant digit to the integer counter 5$c$ respectively. The counters 5$a$ – 5$c$ comprise adders $AD_{16} - AD_{18}$ and shift registers $SF_1 - SF_3$ as shown in FIG. 12. Each of the adders $AD_{16} - AD_{18}$ adds the output from the frequency information memory 4 and the output from the corresponding one of the shift registers $SF_1 - SF_3$. The shift registers $SF_1 - SF_3$ are adapted to store the 12 kinds of outputs in time sequence from the adders $AD_{16} - AD_{18}$ temporarily and feed them back to the input side of the adders $AD_{16} - AD_{18}$. The shift register $SF_1 - SF_3$ respectively have the same number of stages as the maximum number of musical tones to be reproduced simultaneously, e.g. 12 as in the present embodiment. This is an arrangement made for operating the frequency counters in a time-sharing sequence manner, since the frequency information memory 4 receives in time sharing the key address codes stored in the 12 channels (shift register stages) of the key address code memory KAM and produces the frequency information for the respective channels.

Explanation will now be made about this arrangement with respect to the first channel. If the contents of the first channel of the shift register $SF_1$ of the fraction counter 5$a$ are 0, frequency information signals $F_{m1}$ through $F_{m6}$ i.e. the first 6 bits of the fraction section are initially stored in the first channel of the shift register $SF_1$. After a lapse of one key time, new frequency information signals $F_{m1}$ through $F_{m6}$ are added to the contents already stored in the first channel. This addition is repeated at every key time and the signals $F_{m1}$ through $F_{m6}$ are cumulatively added to the stored contents. When a carry takes place in the addition, a carry signal $C_{10}$ is applied from the counter 5$a$ to the next counter 5$b$. The fraction counter 5$b$ consisting of the adder $AD_{17}$ and the shift register $SF_2$ likewise makes cumulative addition of frequency information signals $F_{m7}$ through $F_{m13}$ i.e. the next 7 bits of the fraction section, and the carry signal $C_{10}$ applying a carry signal $C_{20}$ to the adder $AD_{18}$ when a carry takes place as a result of the addition. The integer counter 5$c$ consisting of the adder $AD_{18}$ and the shift register $SF_3$ receives the single digit $F_{m14}$ and the carry signal $C_{20}$ from the adder $AD_{17}$ and makes cumulative addition in the same manner as has been described with respect to the fraction counters 5*a* and 5*b*. The integer outputs of 7 bits stored in the first channel of the shift register $SF_3$ are successively applied to the musical tone waveshape memory for designating the reading addresses to read.

When the depth signals $Bd_1$, $Bd_2$ are OO, the basic frequency information $F_1 - F_{14}$ is directly applied to the counters 5*a* – 5*c* and a period of reading the waveshape memory 6 is constant. On the other hand, when the vibrato information $V_{x1} - V_{x11}$ is applied to the counters 5*a* –5*c*, the value of the frequency information $F_{m1} - F_{m14}$ changes periodically as shown in Table·III. Accordingly, the cumulative count of the integer counter 5*c* increases rapidly during a period of time during which the frequency information $F_{m1} - F_{m14}$ is greater than the basic frequency information $F_1 - F_{14}$, thereby increasing the reading speed of the musical tone waveshape memory 6. This signifies increase in the frequnecy of the musical tone to be reproduced. Conversely, the frequency of the musical tone to be reproduced becomes lower during a period of time during which the value of the frequency information $F_{m1} - F_{m14}$ is smaller than the basic frequency information $F_1 - F_{14}$.

In Table III, the frequency gradually increases for about 32 ms during which the vibrato code $V_1 - V_6$ is at the addresses 0 – 15 until it rises about +25 cents above the basic frequency (180.81 Hz in case of the note $C_2$). Then the frequency gradually decreases for the next 32 ms of addresses 16 – 31 until it returns to the basic frequency. For the next 32 ms of the addresses 32 – 47, the frequency further decreases and falls about –37 cents below the basic frequency. For the next 32 ms of the address 48 – 63, the frequency gradually increases until it returns to the basic frequency. The counting speed of the integer counter 5*c* changes in accordance with the change of the frequency information $F_{m1} - F_{m14}$. This causes change in the reading of the waveshape amplitude from the waveshape memory 6 resulting in reproduction of a musical tone with the vibrato-effect. Thus, 12 musical tones provided with the vibrato effect are reproduced in a time sharing manner. Each tone produced is adjusted in its vibrato period and depth, so that a colorful vibrato effect is achieved.

Figure 16:
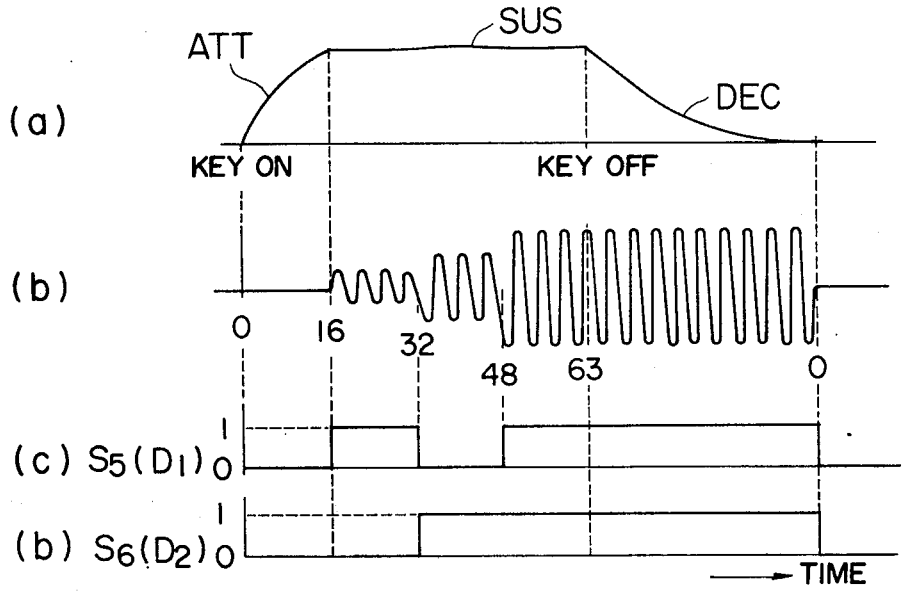
FIG. 16(*a*) is a graphic diagram showing a waveshape read from an envelope counter.
Figure 17:
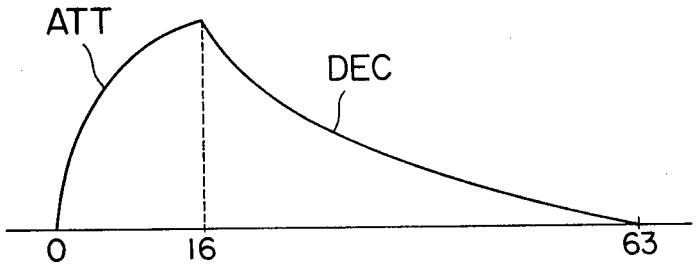
FIG. 17 is a graphic diagram showing a waveshape stored in an envelope memory.

FIG. 16(*a*) shows an envelope waveshape of a musical tone produced by depression of a key. The envelope waveshape is composed of an attack envelope ATT produced by key-on, a decay envelope DEC produced by key-off and a sustain state SUS.

Figure 13:
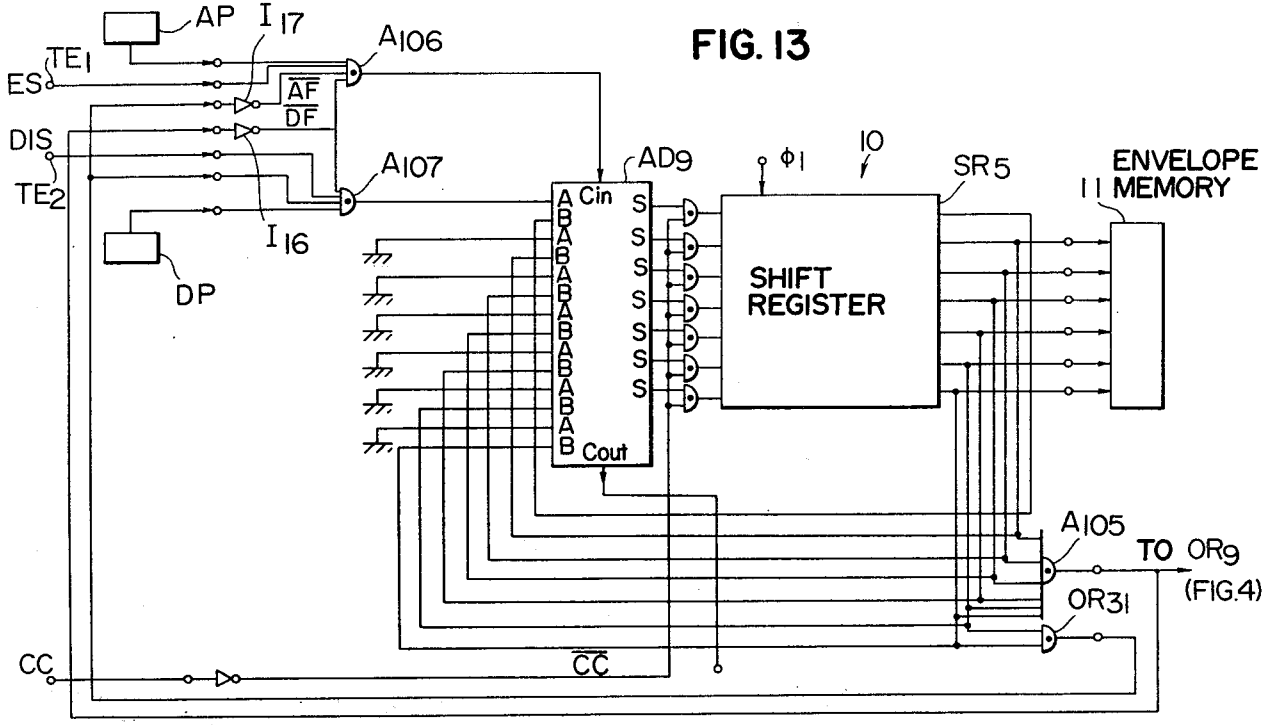
FIG. 13 is a circuit diagram showing a detailed logical circuit of an envelope counter shown in FIG. 1.

FIG. 13 illustrates one example of the envelope counter 10. The envelope counter 10 comprises an adder $AD_9$ and a 12 word 7 bit shift register $SR_5$, the result of addition in the adder $AD_9$ being supplied every 1 key time to corresponding channels of the shift register $SR_5$. More specifically, the adder $AD_9$ adds the output of the shift register $SR_5$ and the clock pulse and provides a result S to the input terminal of the shaft register $SR_5$ thereby causing the envelope counter 10 to successively effect a cumulative counting with respect to each of the channels.

An output representing a counter value is applied from this envelope counter to an envelope memory 11 and a waveshape amplitude stored at an address corresponding to the counted value is successively read from this memory 11. The envelope memory 11 stores an attack waveform at addresses starting from 0 to a predetermined address, e.g. 16, and a decay waveform at addresses from the next address to the last one, e.g. 63.

The counting operation of the envelope counter will now be described with respect to the first channel.

When the attack start signal ES is applied to a terminal $TE_1$, an AND circuit $A_{106}$ which has already received signals 1 obtained by inverting outputs 0 of an AND circuit $A_{105}$ and an OR circuit $OR_{31}$ respectively by inverter $I_{16}$ and $I_{17}$ gates out an attack clock pulse AP to the adder $AD_9$. The adder $AD_9$ and the shift register $SR_5$ successively count the attack clock pulses thereby reading out the attack waveshape of the envelope memory 11. When the counted value has reached 16, an output 1 is produced from the OR circuit $OR_{31}$ and, accordingly, the attack clock pulse AP ceases to pass through the AND circuit $A_{106}$. The attack clock pulse AP remains prevented from passing the AND circuit $A_{106}$ with respect to subsequent counts. Consequently, counting is once stopped and the amplitude stored at address 16 of the envelope memory EM continues to be read out. Thus, a sustain state is maintained.

In this state, an AND circuit $A_{106}$ receives a signal "1" from the OR circuit $OR_{31}$ and also a signal 1 which is obtained by inverting the output 0 of the AND circuit $A_{105}$ by the inverter $I_{16}$. When the decay start signal DIS is applied to a terminal $TE_2$, decay clock pulse DP passes through the AND circuit $A_{107}$ and is applied to the adder $AD_9$. This causes the envelope counter to resume the counting operation for counted values after 16 and the decay waveshape is read from the envelope memory 11. When the counted value has reached 63, all of the inputs to the AND circuit $A_{105}$ become 1 so that the AND circuit $A_{105}$ produces an output 1. Accordingly, the AND circuit $A_{107}$ ceases to gate out the decay clock pulse DP and the counting operation is stopped. Thus, the reading of the envelope waveshape has been completed. This output 1 is applied to the key assigner 3 as a count finish signal DF.

The foregoing description has been made about the embodiment according to which the vibrato depth is constant during a period of time from the start of production of a musical tone by keying-on till the decay-finish after keying-off. The invention is not limited to this but the vibrato depth may be progressively changed during reproduction of the musical tone. An embodiment in which the vibrato depth is progressively changed ("decay vibrato") will be described hereinbelow.

Figure 14:
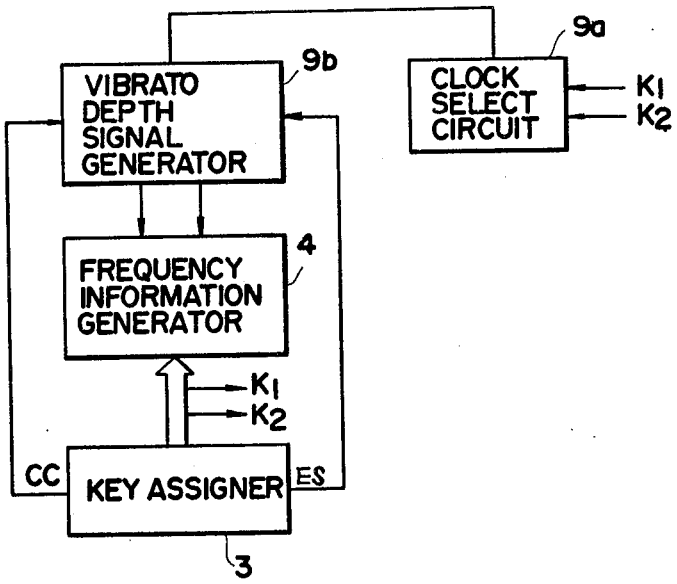
FIG. 14 is a block diagram showing another embodiment of the electronic musical instrument according to the invention, in which figure component parts different from those shown in FIG. 1 only are illustrated.

FIG. 14 shows the embodiment of the electronic musical instrument for producing the decay vibrato. FIG. 14 shows only a circuit portion which is different from the construction shown in FIG. 1, and the rest of the circuit construction is the same as the one shown in FIG. 1. A clock select circuit 9*a* is provided for selecting a clock pulse having a frequency corresponding to the kind of keyboard. The construction of this clock select circuit 9*a* is the same as the circuit 7*a* shown in FIG. 7.

A vibrato depth signal generator 9*b* starts, upon receipt of a signal ES indicating key-on from the key assigner 3, counting of the clock pulse applied from the clock select circuit 9*a*. When the counted value has amounted to a first predetermined value, a second predetermined value, a third predetermined value ---, the vibrato depth signal generator 9*b* produces vibrato depth signals which represent progressively increasing vibrato depths.

Generation of progressively changing vibrato depth signals

Figure 15:
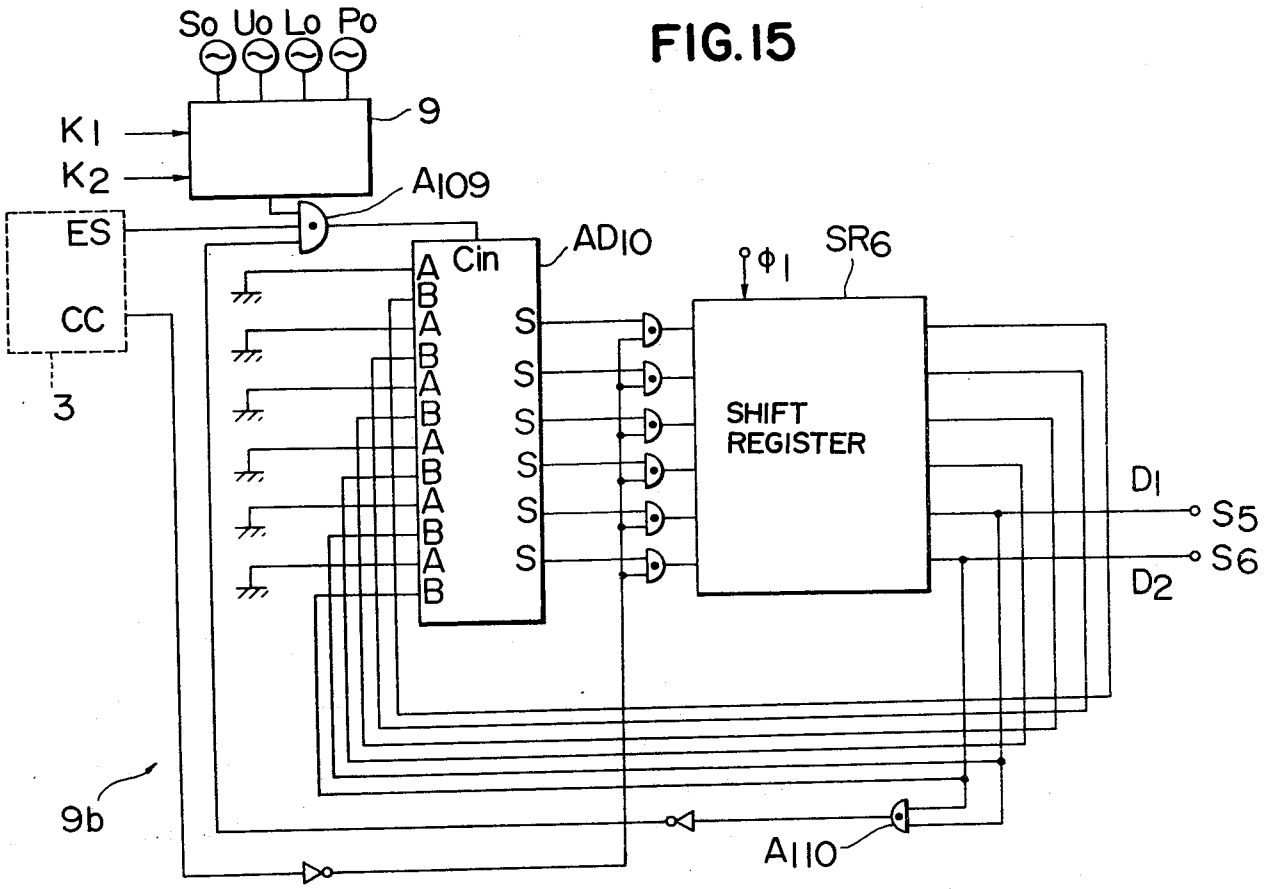
FIG. 15 is a block diagram showing in detail a vibrato depth signal generator shown in FIG. 14.

According to the present embodiment, vibrato depth signals $D_1$, $D_2$ progressively change starting from depression of the key. As shown in FIG. 15 by way of example, the vibrato depth signal generator 9*b* comprises an adder $AD_{10}$ and a 12 word - 6 bit shift register $SR_6$. Upon application of the attack start signal ES from the key assigner 3, the clock pulse from the clock select circuit 9*a* is applied to the adder $AD_{10}$ and cumulatively added therein every 1 key time. The result of the addition is applied to a corresponding channel of the shift register $SR_6$ and counted therein. A bit output $S_6$ of the most significant digit and a bit output $S_5$ which is the output of one digit less significant digit are used as the vibrato depth signals $D_2$, $D_1$. Accordingly, the vibrato depth signals $D_2$, $D_1$ are 0 0 (depth 0) while the count is 0 – 16, 0 1 (depth 1) while the count is 16 – 32 10 (depth 2) while the count is 32 – 48 and 11 (depth 3) while the count is 48 – 63 as shown in FIGS. 16 (*c*) and 16 (*d*). Consequently, the vibrato depth, i.e. the rate of frequency variations progressively increases with a predetermined interval of time after depression of the key, as shown in FIG. 16(*b*). Speed of the progressive change in the vibrato depth can be adjusted by changing the frequency of the clock pulse. Since the clock circuit 9*a* is capable of producing a clock pulse which is different depending upon the kind of keyboard, the speed of change in the vibrato depth can be varied depending upon the kind of keyboard. Accordingly, a delay vibrato effect which is different for each keyboard can be obtained.

In the present embodiment too, thwe progressively changing vibrato signals $D_1$, $D_2$ are applied to the sample hold circuit 9*b*. The subsequent operation of the instrument is the same as has previously been described with respect to the first embodiment, so that description thereof will be omitted.

What is claimed is:

1. An electronic musical instrument comprising:

means for generating a key address code representing the note and keyboard of a depressed key;

a freqeuncy information memory for producing, upon receipt of said key address code, basic frequency information corresponding to said key address code;

a vibrato code generator for counting a clock pulse used for providing a musical tone to be reproduced with a periodic frequency variation and producing a counting output as a vibrato code;

a vibrato information generator for producing an output in the form of a function representing the ratio of the frequency variation in response to the counting output of said vibrato code generator;

a multiplier for multiplying said output in the form of a function with said basic frequency information;

a counter for receiving and counting the result of multiplication by said multiplier; and a musical tone waveshape memory for storing a desired musical tone waveshape which is read out by the output of said counter;

a vibrato effect being produced by frequency-modulating a predetermined pitch corresponding to the depressed key in accordance with the function represented by the output of said vibrato information.

2. An electronic musical instrument as defined in claim 1 further comprising means for changing the frequency of said clock pulse in response to a keyboard code included in said key address code and representing the kind of keyboard and thereupon providing the clock pulse to said vibrato code generator, thereby producing a vibrato effect which is different for each keyboard.

3. An electronic musical instrument as defined in claim 1 further comprising:

an operator for adjusting said ratio of the frequency variation for each keyboard;

a vibrato depth adjusting device for producing a signal representing the vibrato depth for each keyboard in response to a signal output from said operator and a keyboard code representing the kind of keyboard; and means for changing the value of said counting output, i.e. the vibrato code, in accordance with the value of said vibrato depth signal;

whereby a vibrato effect with a vibrato depth which is different for each keybaord is produced.

4. An electronic musical instrument as defined in claim 1 wherein said function is a triangular wave.

5. An electronic musical instrument as defined in claim 1 further comprising:

a vibrato depth signal generator for producing a vibrato depth signal which increases the vibrato depth to a predetermined value from the start of reproduction of the musical tone; and means for changing the counting output, i.e., the vibrato code, in accordance with the value of the vibrato depth signal;

thereby producing a vibrato effect the vibrato depth of which increases during reproduction of the musical tone.

6. An electronic musical instrument as defined in claim 5 further comprising means for controlling the speed of change of the vibrato depth for each keyboard.

* * * * *